US009180995B2

(12) United States Patent
Iyori et al.

(10) Patent No.: US 9,180,995 B2
(45) Date of Patent: Nov. 10, 2015

(54) RETORT CUP

(75) Inventors: Teruaki Iyori, Isehara (JP); Naomi Kotani, Yokohama (JP); Hiroshi Umeyama, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 504 days.

(21) Appl. No.: 13/379,296

(22) PCT Filed: Jun. 18, 2010

(86) PCT No.: PCT/JP2010/004091

§ 371 (c)(1),
(2), (4) Date: Feb. 1, 2012

(87) PCT Pub. No.: WO2010/150500

PCT Pub. Date: Dec. 29, 2010

(65) Prior Publication Data

US 2012/0125926 A1 May 24, 2012

(30) Foreign Application Priority Data

Jun. 23, 2009 (JP) ..... P2009-148498

(51) Int. Cl.
*B65D 3/28* (2006.01)
*B65D 3/14* (2006.01)
(Continued)

(52) U.S. Cl.
CPC .. *B65D 3/14* (2013.01); *B65D 3/22* (2013.01); *B65D 3/28* (2013.01); *B65D 81/3874* (2013.01)

(58) Field of Classification Search
CPC ..... B65D 7/38; B65D 7/34; B65D 35/02; B65D 35/10; C08G 69/34
USPC ..... 220/660, 677, 678, 6; 229/403, 4.5, 229/198.2, 939, 940; 493/162
See application file for complete search history.

(56) References Cited

U.S. PATENT DOCUMENTS 2,266,828 A * 12/1941 Sykes ..... 220/1.5
2,853,222 A * 9/1958 Gallagher ..... 229/402
(Continued)

FOREIGN PATENT DOCUMENTS

CN 1047993 C 1/2000
DE 1137935 10/1962
(Continued)

OTHER PUBLICATIONS

International Search Report for PCT/JP2010/004091, mailed Jul. 13, 2010.
(Continued)

*Primary Examiner* — Fenn Mathew
*Assistant Examiner* — Cynthia Collado

(57) ABSTRACT

A retort cup includes a tubular barrel portion formed of a barrel portion forming blank having a paper layer and thermoplastic resin layers; and a bottom portion which seals one of the openings of the barrel portion. The bottom portion has a downwardly bent peripheral edge portion. The barrel portion has an attached barrel overlap portion where both end edges of the blank are overlapped with each other and sealed, a lower fold-back portion which is formed at a lower end of the barrel portion by folding back the blank inwardly, and an upper fold-back portion which is formed by folding back the ends of the fold-back blank inwardly. The lower end of the barrel portion, the upper fold-back portion, and the peripheral edge portion of the bottom portion are sealed together. The peripheral edge portion is inserted into the lower fold-back portion.

14 Claims, 28 Drawing Sheets

(51) Int. Cl.

| | |
|---|---|
| ***B65D 81/38*** | (2006.01) |
| ***B65D 3/22*** | (2006.01) |

(56) References Cited

U.S. PATENT DOCUMENTS

| | | | | |
|---|---|---|---|---|
| 2,969,901 | A * | 1/1961 | Behrens | 229/400 |
| 5,213,227 | A * | 5/1993 | Koyama et al. | 220/359.3 |
| 5,669,523 | A | 9/1997 | Mueller et al. | |
| 6,253,995 | B1 * | 7/2001 | Blok et al. | 229/403 |
| 7,121,991 | B2 * | 10/2006 | Mannlein et al. | 493/109 |
| 2012/0125926 | A1 * | 5/2012 | Iyori et al. | 220/6 |

FOREIGN PATENT DOCUMENTS

| | | |
|---|---|---|
| JP | 51-122566 | 10/1976 |
| JP | 57-107711 | 7/1982 |
| JP | 58-43264 | 9/1983 |
| JP | 58-183440 | 10/1983 |
| JP | 59-35316 | 3/1984 |
| JP | 60-7290 | 3/1985 |
| JP | 3-295 | 1/1991 |
| JP | 4-59211 | 9/1992 |
| JP | 11-193077 | 7/1999 |
| JP | 2002-37234 | 2/2002 |
| JP | 2004-106843 | 4/2004 |
| JP | 2005-14975 | 1/2005 |
| JP | 2005-104013 | 4/2005 |
| JP | 2005-272010 | 10/2005 |
| JP | 2006-273396 | 10/2006 |
| JP | 2008-24313 | 2/2008 |
| JP | 2008-222244 | 9/2008 |
| JP | 2008-222245 | 9/2008 |
| JP | 2008-222246 | 9/2008 |
| JP | 2008-273592 | 11/2008 |
| JP | 2009-45882 | 3/2009 |
| JP | 2009-73553 | 4/2009 |
| WO | WO 2010/150500 A1 | 12/2010 |

OTHER PUBLICATIONS

Japanese Office Action mailed Mar. 26, 2013 in corresponding Japanese Patent Application No. 2009-036135.

Chinese Office Action mailed Mar. 27, 2013 in corresponding Chinese Patent Application No. 201080027853.4.

Japanese Office Action mailed Jul. 9, 2013 in corresponding Japanese Application No. 2009-188980.

Extended European Search Report mailed Jan. 16, 2014 in corresponding European Application No. 10791823.7.

* cited by examiner

RETORT CUP

TECHNICAL FIELD

The present invention relates to a retort cup structure in which a paper end surface is not exposed to a location contacted by a liquid or the like, and a manufacturing method thereof.

CROSS-REFERENCE TO RELATED APPLICATION

This is the U.S. National Phase Application under 35 U.S.C. §371 of International Patent Application No. PCT/JP2010/004091 filed Jun. 18, 2010, which designated the United States and was published in a language other than English, which claims the benefit of Japanese Patent Application No. 2009-148498, filed Jun. 23, 2009, both of them are incorporated by reference herein. The International Application was published in Japanese on Dec. 29, 2010 as WO2010/150500 A1 under PCT Article 21(2).

BACKGROUND ART

Regarding paper cups which are used after being filled with drinks, such as juice, and for which an upper opening portion is sealed with a lid member, paper cups formed with a joining portion provided to a barrel portion having a blank have generally been used. This blank is formed by punching a laminated material in a predetermined shape. In this laminated material, thermoplastic resin layers, such as polyethylene, are provided on both surfaces of the paper which is the base.

Additionally, when a barrier property against gas, such as oxygen or steam, is required, paper containers, such as a paper cup which is formed using a laminated material with a configuration including a layer having an excellent barrier property, have often been used. As this laminated material, for example a polyethylene film, paper, a polyethylene film, an aluminum foil, a polyethylene terephthalate film, and a polyethylene film, or a polyethylene film, paper, a polyethylene film, a plastic film having a metal oxide vapor-deposited layer, and a polyethylene film are used from the front side.

As a method of securing the barrier property of the joining portion of the paper cup, for example, there is known a method of performing end surface processing (edge protection) which protects end surfaces of both lateral ends of a joining portion of a barrel member which constitutes the barrel portion of the paper cup. This method is a method referred to as skive hemming as shown in FIGS. 2A to 2C.

In this method, a barrel member 100 made of a laminated sheet in which thermoplastic resin 102 is laminated on a paper base 101 is used (refer to FIG. 2A). An outermost layer end edge of the barrel member 100 is skived (cut) by approximately half of the thickness of the barrel member 100 by a cutting milling method or a cutting bell knife method (refer to FIG. 2B). Next, the barrel member 100 of the remaining skived (cut) half is hemmed such that the cut surface is placed inside (folded back), and a paper end surface is protected by the thermoplastic resin (refer to FIG. 2C).

As above, in order to perform skive-hemming process of the paper end surface, it is necessary to perform the skive-hemming process of the paper end surface using a special working machine before the barrel member (blank), which is punched in advance, is formed into a paper cup. Additionally, in order to trim a skived end surface on a straight line, it is difficult to perform cup forming simultaneously when a cup forming machine performs the skive-hemming process. As such, the skive-hemming process involves complicated working processes. Moreover, complete removal of debris generated by skiving (cutting) the paper base 101 is difficult.

Since management of skive depth is difficult in the skive-hemming process, there is a case where a scrap from the skived portion is generated after the forming. As a result, there is a problem in that side sealing or the like is not stable. In addition, in order to use glue for fold-back bonding after skiving in the skive hemming, management of the amount, position, or the like of the glue is difficult.

As a method of producing a cup-like paper container having an excellent barrier property without performing the skive-hemming process, a method of using a blank in which end surfaces of a paper base are covered with a film is proposed (for example, refer to the below Patent Documents 1 to 5).

In the cup-like paper container having a barrier property which protects the end surfaces of this paper base, a thermoplastic resin layer is prepared so as to extend from the paper base, over the whole inner end edge of an attached barrel overlap portion. Thus, the film of the thermoplastic resin layer extending from the paper base in this way will be irregularly formed during cup forming. For this reason, the original purpose of covering the end surfaces of the paper base cannot be sufficiently achieved. Additionally, since the finish as a cup-like paper container is poor, there is a problem in that a defect is caused in the appearance.

Moreover, a method of punching a laminated sheet based on paper in which a thermoplastic resin layer is provided at least on the inner surface in a predetermined shape, and then closely overlapping a resin portion extending outwardly from one lateral end edge of a blank such that the resin portion becomes the inside of the other end edge, thereby forming an attached barrel overlap portion is proposed (refer to the below Patent Document 2). This resin portion is closely covered with the blank along the end surfaces of the base.

Moreover, in an opening portion of the cup-like paper container, a flange portion is formed by winding an upper end edge of the barrel member one round or more.

By providing the flange portion at the opening portion of the cup-like paper container in this way, deformation of the paper container can be suppressed even when a force is applied thereto from the outside. Thus, it is possible to provide a paper container which is suitable for use as the mouthpiece of a drink container.

Moreover, since sealing can be performed by overlapping the top surface of the flange portion with a lid member, the cup-like paper container is suitable as a cup-like paper container for an application which requires sealing.

Additionally, in order to more easily perform sealing using the lid member, a flange portion prepared by winding an upper end edge of the barrel member is pressed from an up-and-down direction, and is brought into a flat state.

Ultrasonic means other than ordinary heating and pressing means can be used as the means for bringing the flange portion into the flat state.

As such, when the upper end edge of the barrel member is wound in the opening portion to form the flange portion, a stepped portion caused by the thickness of the paper which is the base is generated in the flange portion. Therefore, when the lid member is overlapped with the top surface of the flange portion, and is heated and sealed, sealing cannot be reliably performed due to the stepped portion. Particularly, when the flange portion is in a flat state, the influence caused by the thickness of the base is great.

Additionally, in order to fill the stepped portion of the top surface of the flange portion to reliably perform sealing, it is necessary to provide a filling member made of a separate resin or the like to eliminate the stepped portion, and partially perform sealing of the position of the stepped portion.

As such, when the lid member is overlapped with the top surface of the flange portion and sealed, a gap may be generated in the sealed portion of the lid member due to the level difference of the flange portion if the upper end edge is wound while the flange portion of the upper portion of the attached barrel overlap portion overlaps the paper base of the attached barrel overlap portion. Additionally, there are problems such as the finish as a cup-like container being poor, and a defect is caused in the appearance.

In order to solve this problem, in a cup-like paper container in which a tubular barrel member and a bottom member below this barrel member are integrated, a configuration in which the lateral end edge located inside the overlap portion of the blank has a resin portion extending from the lateral end edge of the base, and a cutout portion is provided in an upper portion of the lateral end edge which is not provided with the resin portion is suggested in the below Patent Document 5. This blank is made up of, for example, a laminated sheet based on paper which has a thermoplastic resin layer provided at least on the inner surface thereof. This tubular barrel member is formed with an attached barrel overlap portion obtained by overlapping one lateral end edge of the blank with the other lateral end edge, and a flange portion obtained by winding an upper end edge one round or more.

In this method, by providing a cutout portion in an upper portion of the lateral end edge of the barrel member, the barrel member is not wound while being overlapped in the flange portion of the upper portion of the attached barrel overlap portion. Therefore, a flange portion with a small level difference is formed, so that a gap of a sealed portion can be made small when sealed by the lid member.

However, the amount of resin required for bonding the lid member may be insufficient merely by providing the cutout portion in the upper portion of the lateral end edge of the barrel member which does not provide the resin portion. Moreover, the problem that the sealing using resin of the end surface of the barrel member in the upper flange portion of the attached barrel overlap portion becomes easily imperfect is left unsolved.

Moreover, a paper container in which a laminated sheet based on paper in which a thermoplastic resin layer is provided on the inner surface is punched in a predetermined shape, and then, a fold-back resin portion of the blank is closely overlapped with the base such that the resin portion becomes the inside of the other end edge, thereby forming an attached barrel overlap portion is proposed (refer to the below Patent Document 3). This fold-back resin portion is formed as the resin portion which extends outwardly from one lateral end edge and is folded back to the outer surface side.

This paper container is protected as the inner-surface-side base end surface in the attached barrel overlap portion is covered with the thermoplastic resin layer. Additionally, in the case of the cup-like container, the upper end edge of the barrel member is wound in the opening portion to form the flange portion. Therefore, a stepped portion caused by the thickness of the paper which is a base is generated in the flange portion. For this reason, when the lid member is overlapped with the top surface of the flange portion, and is heated and sealed, sealing cannot be reliably performed due to the stepped portion. The below Patent Document 3 suggests a solution to confront this problem.

However, a problem that the barrier property of the end surface of the lower end edge of the barrel member in a container bottom surface portion of the cup-like container is insufficient is left unsolved in terms of the protection of the end surface of the paper base. That is, while the end surface of the peripheral edge portion of the bottom member of the cup is pinched by the fold-back of the lower end of the barrel member, the lower end of the barrel member is fixed in the state of being folded back to the inside of the container, and the end surface is exposed to the air. Therefore, the cup is weak in terms of penetration of water through the paper end surface.

PRIOR ART DOCUMENTS

Patent Documents

[Patent Document 1] Japanese Unexamined Patent Application, First Publication No. S51-122566

[Patent Document 2] Japanese Unexamined Patent Application, First Publication No. 2005-272010

[Patent Document 3] Japanese Unexamined Patent Application, First Publication No. 2008-222245

[Patent Document 4] Japanese Examined Patent Application, First Publication No. S58-43264

[Patent Document 5] Japanese Unexamined Patent Application, First Publication No. 2008-222246

DISCLOSURE OF INVENTION

Problems to be Solved by the Invention

When a container having an excellent barrier property is formed, a problem occurs in a case where a resin portion film composed of the thermoplastic resin layer provided such that the lateral end edge located outside the overlap portion of the barrel member extends is formed so as to protrude.

That is, in the above related art in the cup-like container, the laminated sheet provided is punched in a predetermined shape, and the blank having the fold-back resin portion is overlapped and brought into close contact with the base so as to become the inside of the other end edge, thereby forming a paper container having an attached barrel overlap portion. This laminated sheet is based on paper which has a thermoplastic resin layer provided at least on the inner surface thereof. This fold-back resin portion is formed as the resin portion which extends outwardly when one lateral end edge is folded back to the outer surface side. In this related art, there are problems in that, due to wrinkles or the like in the overlap portion of the outer-surface-side base end surface in the attached portion, not only is a defect caused in appearance, but penetration of moisture from the outside occurs easily.

The aspect of the invention has been made in view of this problem, and aims at providing a retort cup which does not impede covering of paper end surfaces, and has a neat finish appearance in the capacity of a retort cup and a barrier property.

Additionally, another aspect of the invention aims at providing paper containers, such as a retort cup having excellent water resistance and sealing performance.

Additionally, still another aspect of the invention aims at providing a manufacturing method of a paper container and a retort cup which makes a retort cup and a paper container from a roll-like paper base.

Additionally, a still further aspect of the invention aims at providing a retort cup in which sealing of a lid member is easy, and sealing performance is excellent, in a retort cup in which a barrel member is wound into an opening portion to form a flange portion, particularly, a retort cup in which a flat flange portion is formed.

Means for Solving the Problems

A retort cup related to an aspect of the invention includes a tubular barrel portion formed of a barrel portion forming blank having a paper layer and thermoplastic resin layers provided on both surfaces of the paper layer; and a bottom portion which seals one of the openings of the barrel portion. The bottom portion has a downwardly bent peripheral edge portion. The barrel portion has an attached barrel overlap portion where both end edges of the barrel portion forming blank are overlapped with each other and sealed, a lower fold-back portion which is formed at a lower end of the barrel portion by folding back the barrel portion forming blank inwardly, and an upper fold-back portion which is formed by folding back the ends of the fold-back barrel portion forming blank inwardly. The lower end of the barrel portion, the upper fold-back portion, and the peripheral edge portion of the bottom portion are closely sealed together, with the peripheral edge portion of the bottom portion being inserted into the lower fold-back portion.

In the above aspect, end edge extending portions provided such that the thermoplastic resin layers extend over a predetermined width may be provided at both end edges of the barrel portion.

In the above aspect, the end edge extending portion located inside the barrel portion in the attached barrel overlap portion may be folded back to the outside of the barrel portion and located between the end edges.

In the above aspect, the end edge extending portion located outside the barrel portion in the attached barrel overlap portion may be folded back to the inside of the barrel portion and located between the end edges.

In the above aspect, the end edge extending portion may be provided over the total length of the end edge.

In the above aspect, the end edge extending portion located outside the overlap portion may come into close contact with the barrel portion forming blank located inside the overlap portion.

In the above aspect, the thermoplastic resin layer may include a layer having a gas barrier property.

In the above aspect, the barrel portion may form a flange portion with a flat top surface.

In the above aspect, the paper layer of the corner where the flange portion is formed may have a cutout portion provided such that the barrel portion forming blank is cut out.

In the above aspect, the corner of the paper layer of the barrel portion forming blank which is sealed by the bottom portion is cut out.

In the above aspect, the barrel portion may have a thermoplastic resin layer provided so as to extend from the cutout portion.

In the above aspect, the end of the peripheral edge portion may be spaced apart from each of the upper fold-back portion and the lower fold-back portion.

A manufacturing method of a retort cup related to another aspect of the invention includes a punching step of punching a laminated sheet based on paper to form a blank in a predetermined shape; a resin portion forming step of forming resin portions extending outwardly from end edges of the blank, respectively; a resin portion fold-back step of folding back the resin portion; and a barrel portion forming step of closely overlapping the end edges to form an attached barrel overlap portion.

In the above aspect, in the resin portion fold-back step, one of the resin portions may be folded back, and in the barrel portion forming step, the end edges may be closely overlapped with each other to form an attached barrel overlap portion such that the fold-back resin portion becomes the inside of the other resin portion.

Effects of the Invention

According to the retort cup related to the aspect of the above invention, exposed portions of the end edges of the barrel portion forming blank on the side of the bottom portion are sealed to protect the end surfaces.

Thereby, since the paper end surfaces of the barrel portion forming blank on the side of the bottom portion are covered, the liquid in the retort cup is prevented from permeating from the paper end surfaces and wetting the paper. As a result, the strength of the paper layer does not deteriorate. Additionally, since not only the permeation from the inside of the retort cup but also the permeation from the outside is prevented, it is possible to provide a retort cup having water resistance which withstands boiling, retort sterilization, or soaking and cooling in water.

Additionally, according to the retort cup related to this aspect, the end edge extending portions provided such that the thermoplastic resin layers laminated on the base sheet extend with a predetermined width along the end edges are provided at both facing end edges of the barrel portion forming blank. Therefore, sealing of the base ends can be performed. Additionally, this sealing can be reliably performed by being brought into close contact with and thermally pressure-bonded to the base of the other end which overlaps in the attached barrel overlap portion. Moreover, peeling-off between the layers and deterioration of appearance, which are caused as the end edge extending portions of the attached barrel overlap portion are isolated from the blank, can be avoided.

Additionally, according to the retort cup related to this aspect, the inner end edge extending portion in the attached barrel overlap portion of the barrel portion forming blank is folded back to the outside of the retort cup and is pressure-bonded in the state of being located between the inner end edge and the outer end edge, whereby the inner end edge is covered with the end edge extending portion. As a result, penetration of water can be more reliably prevented.

Moreover, the end of the inner end edge extending portion is sealed between the outer base and the inner base, so that exposure of the end can be prevented. Particularly, for example, when the thermoplastic resin layer on the inner surface of the base has a laminated structure including a gas barrier layer made of metal, an inorganic substance, or the like, with no water resistance or gas resistance, protection of the resin layer can be performed.

Additionally, according to the retort cup related to this aspect, the outer end edge extending portion in the attached barrel overlap portion of the barrel portion forming blank is folded back to the inside of the retort cup and is pressure-bonded in the state of being located between the inner end edge and outer end edge, whereby the end edge outside the joining surface of the bases of the barrel portion is covered with the end edge extending portion. As a result, penetration of water can be more reliably prevented.

Moreover, the end of the outer end edge extending portion is sealed between the outer base and the inner base, so that exposure of the end can be prevented. Particularly, for example, when the resin layers on both surfaces of the base have a laminated structure including a gas barrier layer made of metal, inorganic substance, or the like, with no water resistance or gas resistance, protection of the resin layers can be performed.

Moreover, the inner end edge extending portion is folded back to the outside of the retort cup and is pressure-bonded in the state of being located between the inner end edge and the outer end edge, whereby the barrier property in the joining surface of the bases of the barrel portion is more reliably improved.

Additionally, according to the retort cup related to this aspect, a retort cup in which the sealing performance of the attached barrel overlap portion is excellent can be provided by providing the end edge extending portion over the total length of the end edge.

In the skive hemming method, there are quality problems, such as debris after paper is shaved, protrusion of glue, and breakage of a skived portion. From the retort cup related to this aspect, these quality problems are solved by performing edge protection using a film covering method.

Additionally, even for the bottom portion of the retort cup, exposure of the end surfaces of the barrel member at the bottom portion is eliminated by increasing the amount of curling of the bottom portion of the barrel member by pinching and sealing the ends between the barrel member and the bottom member. Therefore, all the edges of the retort cup are protected, and the retort cup can be applied to the fields (a retort, toiletry, seasonings, supplements, and etc.) which have not been able to use the retort cup until now.

Moreover, in the retort cup related to this aspect, a layer which seals the end surface of the paper base is formed on the thermoplastic resin layer without bending the paper base or the like, whereby end surface processing (edge protection) is performed. For this reason, a retort cup in which a high-quality oxygen barrier property, a steam barrier property, or the like is improved with no pinhole, crack, or the like, is obtained.

Additionally, according to the retort cup related to this aspect, problems, such as deterioration of appearance caused by a stepped portion produced in the attached barrel overlap portion in a state where the outer-surface-side base end surface is overlapped in the attached portion, and penetration of moisture from the outside by wrinkles or the like at the time of overlap, can be solved.

Additionally, according to the retort cup related to this aspect, the resin portion which extends from the end edge located outside the overlap portion of the blank has the fold-back resin portion which is folded back to the outer surface or inner surface side of the base, so that sealing of the ends of the base can be reliably performed. Moreover, the amount of resin of the attached barrel overlap portion can be secured. Additionally, when the thermoplastic resin layer includes a gas barrier layer, a paper container in which the end surfaces of the gas barrier layer are not exposed can be obtained.

Additionally, according to the retort cup related to this aspect, the resin portion which extends from the end edge located outside the overlap portion of the blank comes into close contact with the blank inside the overlap portion therealong, so that sealing of the ends of the base can be reliably performed. As a result, a paper container which can secure the amount of resin of the attached barrel overlap portion is obtained.

Additionally, according to the retort cup related to this aspect, a paper container in which the preservation property of contents is excellent can be obtained through the configuration in which the thermoplastic resin layer of the inner surface has a gas barrier layer.

Additionally, according to the retort cup related to this aspect, the retort cup is produced using a barrel member blank in which the thermoplastic resin layer is provided on the cutout portion provided such that the paper layer at an upper corner of the barrel member blank made of a laminating material for the blank composed of at least the paper layer and the thermoplastic resin layer is cut out. Therefore, the level difference caused by the overlap of the paper layers at a joining portion of both ends of the barrel member can be eliminated in the winding for forming the flange portion above the joining portion. Simultaneously, the upper portion of the flange portion can be made flat due to the filling effect of the thermoplastic resin to prevent a gap from being generated at the time of sealing of a lid member.

Additionally, according to the retort cup related to this aspect, the thermoplastic resin layer is provided so as to extend from the end edge of the paper layer of the barrel portion, and the extending portion thereof is folded back and bonded so as to cover the end edge of the paper layer. Therefore, formation of the barrel member is performed using the barrel member blank in which the end surface is covered with the thermoplastic resin layer. Thus, penetration of contents or moisture from the end edge of the paper layer of the barrel portion can be effectively prevented.

In this way, in the retort cup in which the barrel member is wound into the opening portion to form the flange portion, particularly, the retort cup in which a flat flange portion is formed, the effects of protection of the end edge of the paper layer and improvement in close contact of the upper flange portion with the lid member can be simultaneously realized. As a result, it is possible to provide a retort cup in which sealing of the lid member is easy and sealing performance is excellent.

Additionally, according to the retort cup related to this aspect, the thermoplastic resin layer which constitutes the barrel member blank contains a gas barrier layer, whereby the inner surface side of the barrel member is protected, and a gas barrier property is secured. Thus, it is possible to provide a retort cup in which the preservation property of contents is excellent.

Additionally, since the thermoplastic resin layer is provided so as to extend from the end edge of the paper layer of the barrel portion, and the extending portion thereof is folded back and bonded so as to cover the end edge of the paper layer, the amount of resin of the attached barrel overlap portion can be secured, and the level difference of the attached barrel overlap portion is not easily caused. Moreover, in the case of the thermoplastic resin layer including a gas barrier layer, it is possible to provide a retort cup in which the end surfaces of the gas barrier layer are not exposed to the inside.

Additionally, according to the retort cup related to this aspect, the thermoplastic resin layer extending portion is formed of the thermoplastic resin layer of the blank which forms the barrel member. Thus, additional processes, such as tape attachment or the loke, are not required, and it is not necessary to use a special material. Thus, a retort cup in which the preservation property of contents is excellent is simply and easily obtained.

Additionally, according to the retort cup related to this aspect, the flat state of the top surface of the flange portion can be easily realized. That is, the top surface of the wound flange portion can be made flat with no level difference, and sealing can be more reliably performed with no gap by overlapping and sealing the lid member onto the top surface of the flange portion as it is.

Additionally, according to the manufacturing method of a retort cup applied to another aspect of the invention it is possible to provide a manufacturing method of a retort cup which manufactures a retort cup, which does not impede covering of paper end surfaces and has a neat finish appearance as the retort cup and a barrier property, directly from a roll-like paper base.

Moreover, an end surface folding-back device for end edges can be provided on a retort cup forming machine which molds a retort cup. For this reason, the retort cup can be more efficiently produced with little loss between respective processes.

Additionally, since the end surface of the lateral end edge is subjected to end surface protection processing in the state of a web-like sheet, the width of selection of the forming machine which forms a retort cup or a paper container increases. For this reason, manufacture of a retort cup using an extensive forming machine of a winding type, a sheet type, or the like is attained. Additionally, since unnecessary portions of the web-like sheet are cut, a conventional cup forming machine can be easily applied.

Moreover, a layer which seals the end surface in the thermoplastic resin layer without bending the paper base or the like is formed by the end surface processing (edge protection). For this reason, a retort cup in which a high-quality oxygen barrier property, a steam barrier property, or the like is improved with no pinhole, crack, or the like, is obtained.

EMBODIMENTS FOR CARRYING OUT THE INVENTION

A retort cup related to an aspect of the invention includes a configuration in which edge protection of both the inner and outer surfaces of the retort cup can be performed by covering the inner surface side and outer surface side of paper end surfaces of both lateral end edges of a barrel member with a film to fold back a bottom portion of the barrel member.

The edge protection methods of a barrel member joining portion include a method of folding back a film and a simple method which does not fold back a film. With respect to the inner surface side and outer surface side of the paper end surfaces of both lateral end edges of the barrel member, any of the methods can be adopted, respectively, if required. The method of folding back a film is suitable for a case where there is a layer where a problem occurs if a metal layer or the like is exposed to the layer of a resin film because contents do not come into contact with the end surfaces of the film. Additionally, the method which does not fold back a film can also protect the edges of the paper which is a base simply by removing unnecessary portions of the barrel member.

In the edge protection of the bottom portion of the barrel member in the retort cup related to the aspect of the invention, edge protection can be performed without exposing paper base end surfaces even in the bottom portion by sealing the bottom portion after a bottom portion inward curl after heating of the bottom portion is curled until the end surfaces are turned inward by a forming machine. A material working processing can be performed similarly to the present process.

(1) First Embodiment

A retort cup related to a first embodiment of the invention will be described below with reference to the drawings.

The retort cup related to the present embodiment is made up of a base sheet based on paper which has thermoplastic resin layers provided on the inner and outer surfaces thereof.

Figure 1:
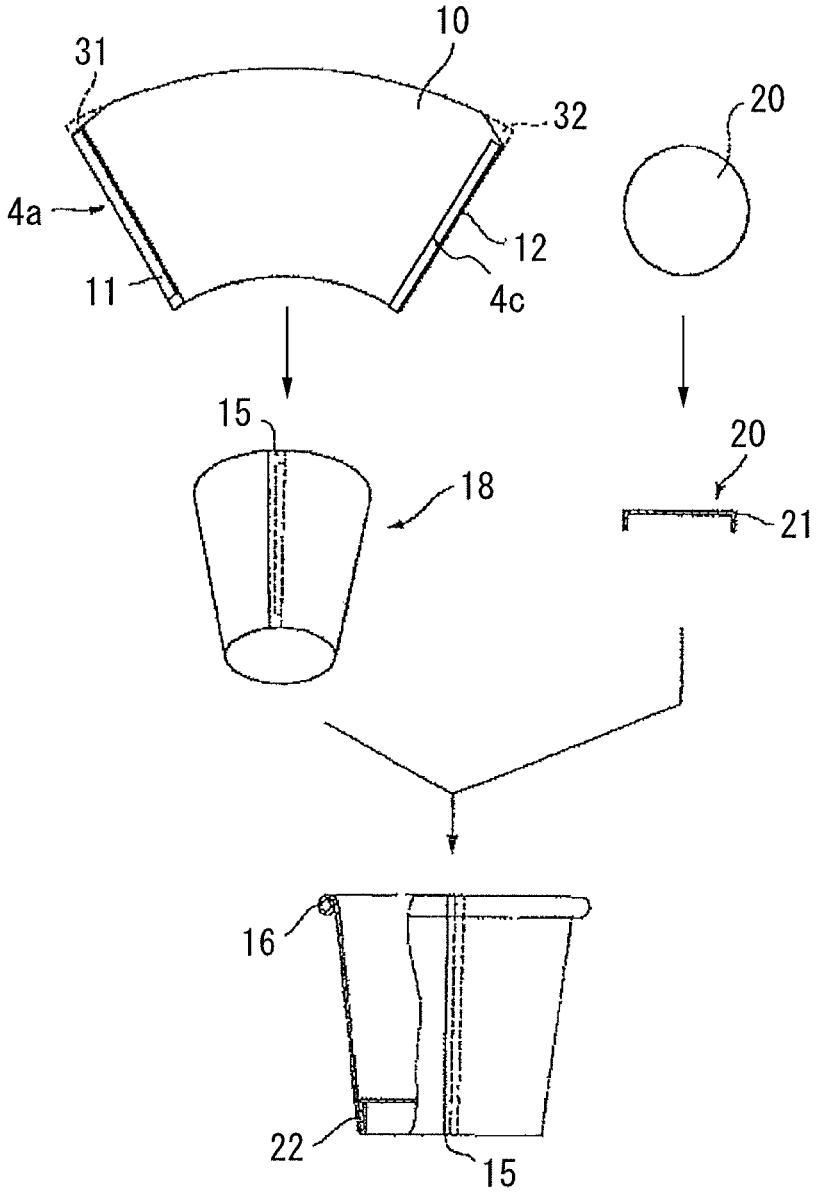
FIG. 1 is a schematic view showing a manufacturing process of a retort cup related to a first embodiment of the invention.
Figure 2A:
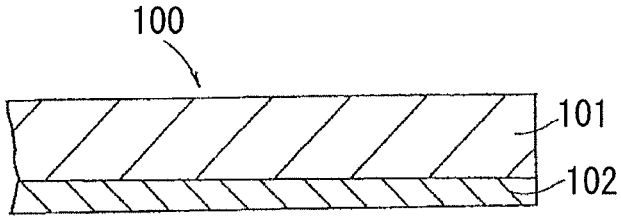
FIG. 2A is a partial cross-sectional view showing a method of edge protection by skive-hemming process.
Figure 2B:
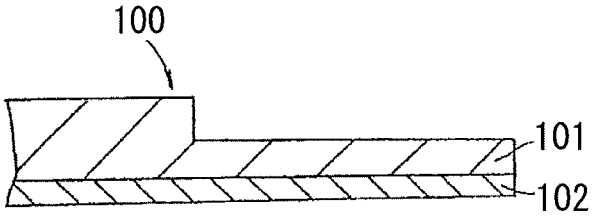
FIG. 2B is a partial cross-sectional view showing the method.
Figure 2C:
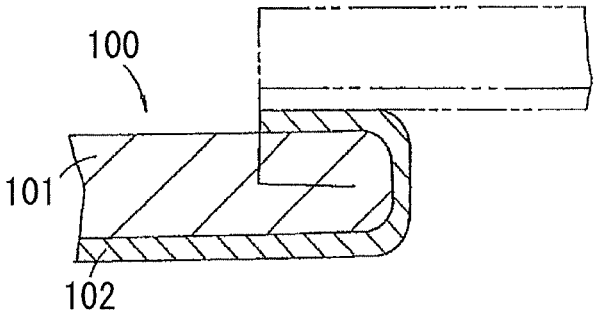
FIG. 2C is a partial cross-sectional view showing the method.

FIG. 1 is a schematic view showing an example of a manufacturing process of the retort cup related to the present embodiment.

As shown in FIG. 1, a barrel member 18 is formed in a cylindrical shape which has an attached barrel overlap portion 15. The attached barrel overlap portion 15 is formed such that one end edge 11 of the barrel member blank 10 is overlapped with the other end edge 12. Cutout portions 31 and 32 are respectively provided in upper portions of both lateral end edges of the barrel member blank 10. Additionally, a bottom member 20 has a circular shape and has a peripheral edge portion 21 which is erected downwardly. The outer surface of the peripheral edge portion 21 of the bottom member 20 is joined to the lower inner surface of the barrel member 18.

Next, the lower end edge of the barrel member 18 is bent downwardly so as to cover the peripheral edge portion 21 and is joined to the inner surface of the peripheral edge portion 21 of the bottom member 20, whereby an annular leg 22 is formed. A flange portion 16 is formed by winding the upper peripheral edge of the barrel member 18 outwardly one round or more. The retort cup is formed in this way. Such a structure is not limited only to the tapered retort cup, and may be a cylindrical cup-like paper container.

Generally, the retort cup related to the present embodiment is provided with the flange portion 16. A barrel member blank 10 in which the cutout portions 31 and 32 are respectively provided in the upper portions of both lateral end edges is used. Therefore, when the upper peripheral edge of the barrel member 18 is wound outwardly one round or more to form the flange portion 16 with at least three-fold configuration, even at the upper end of the attached portion 15 of the barrel member 18, the paper base (paper layer) 1 is brought into a wound state with the same three-fold configuration as portions other than the attached portion 15.

Here, by forming the cutout portions 31 and 32 in different shapes, the level difference of the top surface of flange portion 16 caused at the position of the attached portion 15 can be eliminated even if the top surface of the flange portion 16 with at least a three-fold configuration is made flat.

Figure 3A:
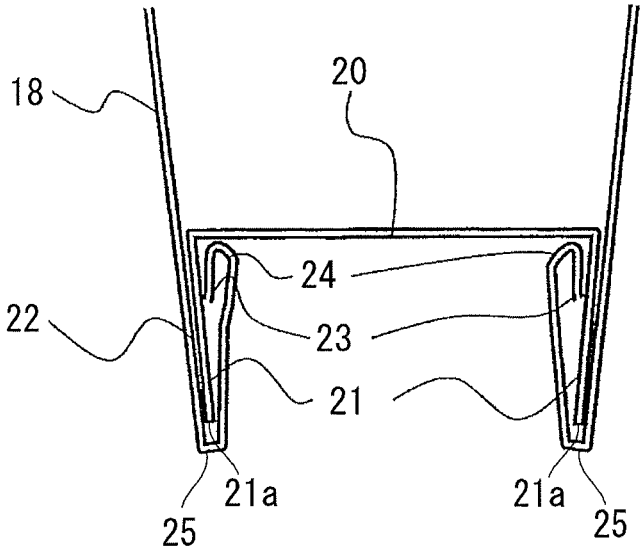
FIG. 3A is a partial cross-sectional view showing a curled state of a barrel member lower end in an attached bottom overlap portion of the retort cup related to the above embodiment.
Figure 3B:
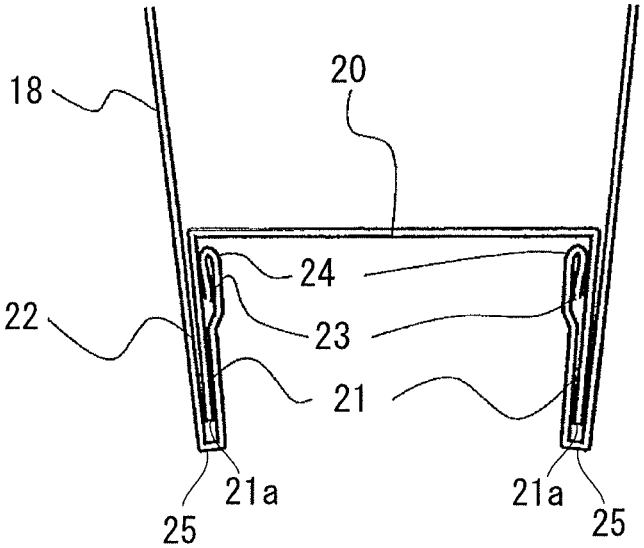
FIG. 3B is a partial cross-sectional view showing a state where the curled state shown in FIG. 3A in the attached bottom overlap portion of the retort cup related to the embodiment is thermally pressure-bonded.

FIG. 3A is a partial cross-sectional view showing a curled state of a barrel member lower end in the attached bottom overlap portion of the retort cup related to the present embodiment. FIG. 3B is a partial cross-sectional view showing a state where the curled state shown in FIG. 3A in the attached bottom overlap portion of the retort cup related to the embodiment is thermally pressure-bonded.

As shown in FIG. 3A, the peripheral edge portion 21 of the bottom member 20 is inserted into the lower inner surface of the tubular barrel member 18 made of the barrel portion forming blank 10. The peripheral edge portion 21 of the bottom member 20 is formed by bending the peripheral edge portion of a bottom portion forming blank downwardly. Next, a lower end 23 of the barrel member 18 is folded back inwardly, and the upper portion thereof is folded back inwardly. An upper fold-back portion 24 and a lower fold-back portion 25 are formed in this way. As a result, the bottom portion of the retort cup related to the present embodiment is brought into a state where the lower end 23 of the barrel member is located between the upper fold-back portion 24 and the downwardly bent portion of the bottom member 20. That is, the peripheral edge portion 21 of the bottom member 20 is brought into the state of being inserted into the lower fold-back portion 25.

Moreover, the annular leg 22 is formed by bringing the lower end 23 and upper fold-back portion 24 of the barrel member 18 into close contact with the peripheral edge portion 21 of the bottom member 20 and joining the lower end and upper fold-back portion of the barrel member to the inner surface of the peripheral edge portion 21 of the bottom member 20 (FIG. 3B) by heat sealing.

As a result, the lower end 23 of the barrel member 18 is brought into the state of being sealed by the inner surface of the peripheral edge portion 21 of the bottom member 20 and the barrel member near the upper fold-back portion 24 of the barrel member 18. As a result, penetration of moisture or the like from this portion is prevented.

Additionally, an end 21*a* of the peripheral edge portion 21 may be spaced apart from the upper fold-back portion 24 and the lower fold-back portion 25, respectively.

Figure 4A:
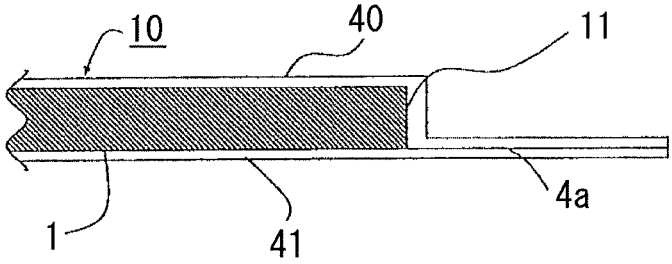
FIG. 4A is a partial cross-sectional view showing a blank which becomes the inside of the attached barrel overlap portion of the retort cup related to the embodiment.
Figure 4B:
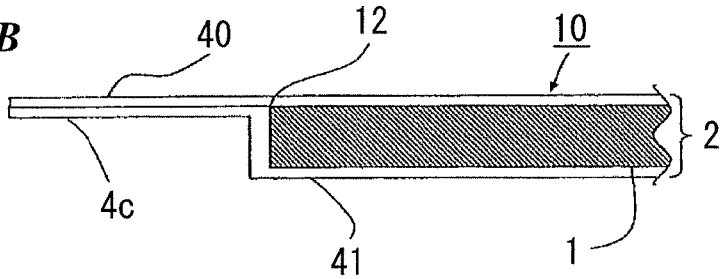
FIG. 4B is a partial cross-sectional view showing the blank which becomes the outside of the attached barrel overlap portion of the retort cup related to the embodiment.
Figure 4C:
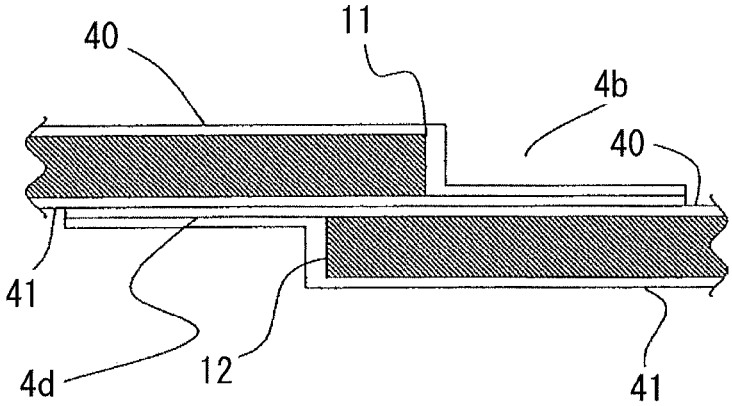
FIG. 4C is a partial cross-sectional view showing the attached barrel overlap portion after attachment of the retort cup related to the embodiment.

FIG. 4A is a partial cross-sectional view showing a blank which becomes the inside of the attached barrel overlap portion of the retort cup related to the present embodiment. FIG. 4B is a partial cross-sectional view showing the blank which becomes the outside of the attached barrel overlap portion of the retort cup related to the present embodiment. FIG. 4C is a partial cross-sectional view showing the attached portion after attachment of the retort cup related to the present embodiment.

As shown in FIGS. 4A to 4C, the barrel member blank 10 includes a configuration having an end edge extending piece (end edge extending portion) 4*a*, which is formed as a thermoplastic resin layer 40 on the side of a base sheet inner surface and a thermoplastic resin layer 41 on the side of a base sheet outer surface extend outwardly from a lateral end edge of the paper base 1, in the inner base end edge 11 located inside the container in the attached barrel overlap portion 15.

Additionally, the barrel member blank 10 includes a configuration having an end edge extending piece (end edge extending portion) 4*c*, which is formed as the thermoplastic resin layer 40 on the side of the base sheet inner surface and the thermoplastic resin layer 41 on the side of the base sheet outer surface extend outwardly from a lateral end edge of the paper base 1, in the outer base end edge 12 located outside the container in the attached barrel overlap portion 15.

By adopting the configuration in which the end edge extending piece 4*a* extends outwardly from the lateral end edge of the paper base 1 in this way, the amount of resin in the attached barrel overlap portion 15 can be secured. As a result, the sealing performance of the inner surface of the attached portion becomes excellent, and the barrier property of the paper base end surfaces is improved.

Additionally, by adopting the configuration in which the end edge extending piece 4*c* extends outwardly from the lateral end edge of the paper base 1, the amount of resin in the attached barrel overlap portion 15 can be secured. As a result, the sealing performance of the outer surface of the attached portion becomes excellent, and the barrier property of the paper base end surfaces is improved.

Since the retort cup related to the present embodiment has such a structure, the end surface of the paper base located inside the attached barrel overlap portion 15 is protected by the end edge extending piece 4*a* which is sealed by thermal pressure-bonding. Additionally, the end surface of the paper base located outside the attached barrel overlap portion 15 is protected by the end edge extending piece 4*c* which is sealed by thermal pressure-bonding. For this reason, not only do the contents filled into the container not penetrate from the paper base end surfaces, but also the edge protection effect of preventing penetration of water from the outside of the container during retorting or the like is obtained.

By providing the thermoplastic resin layers 40 and 41 on both surfaces of the paper base 1 in this way, the end edge extending pieces 4*a* and 4*c* which extend outwardly to the base end surfaces are formed, with the thermoplastic resin layers 40 and 41 on both the surfaces being integrated at the outer edges.

By adopting the configuration in which the end edge extending pieces 4*a* and 4*c* extend outwardly from the end edges of the paper base 1 and are thermally pressure-bonded, the level difference of the attached barrel overlap portion is filled by the end edge extending pieces 4*a* and 4*c*. As a result, not only a configuration with no level difference can be adopted, but also a configuration in which the paper base 1 is not exposed to the inside and outside of the paper container can be adopted.

Particularly, the end edge extending piece 4*a* is formed at the end of the paper base 1 bonded to the inside of the attached barrel overlap portion 15 by the thermoplastic resin layers 40 and 41 on both the surfaces. A resin portion composed of the end edge extending piece 4*a* is formed by simple thermal pressure-bonding. Thereafter, the resin portion composed of the end edge extending piece 4*a* is brought into close contact with and fixed to a resin portion composed of the end edge extending piece 4*c* formed at the end of the outer paper base 1, and the thermoplastic resin layer 41 formed on the outer surface near the end of the paper base 1. Therefore, required end protection can be performed, and a constant amount of resin can be secured at a bonded portion. Moreover, as the outer and inner end surfaces of the paper base 1 overlap each other, the strength of the attached barrel overlap portion 15 can be secured.

In the paper container related to the present embodiment, the thermoplastic resin layer 40 may be configured to have a layer including a barrier layer. Through the configuration including a barrier layer in this way, the end surfaces of the paper base 1 can be protected by the barrier layer. Therefore, it is possible to provide a retort cup having an excellent barrier property.

Figure 5A:
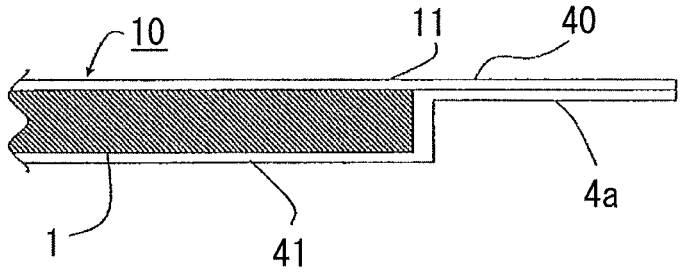
FIG. 5A is a partial cross-sectional view showing a blank which becomes the inside of the attached barrel overlap portion of the retort cup related to the embodiment.
Figure 5B:
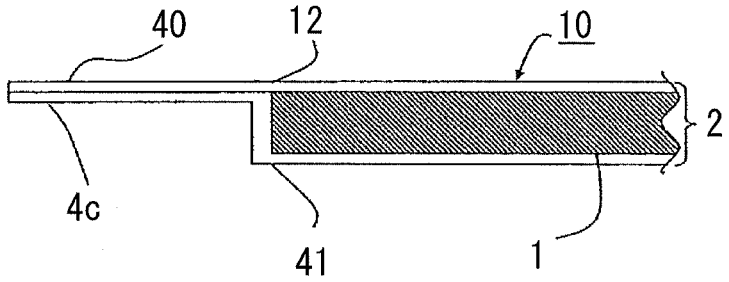
FIG. 5B is a partial cross-sectional view showing the blank which becomes the outside of the attached barrel overlap portion of the retort cup related to the embodiment.
Figure 5C:
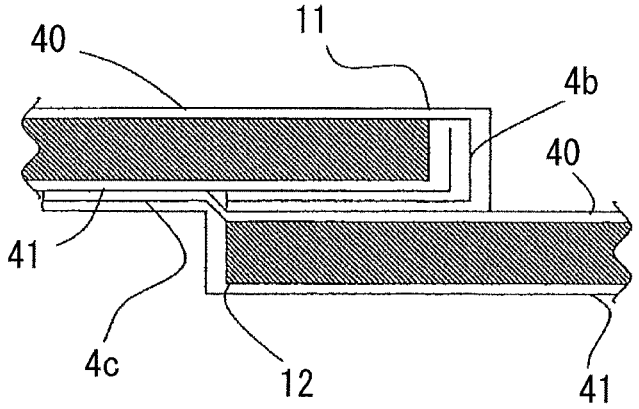
FIG. 5C is a partial cross-sectional view showing the attached barrel overlap portion after attachment of the retort cup related to the embodiment.

FIG. 5A is a partial cross-sectional view showing a blank which becomes the inside of the attached barrel overlap portion of the retort cup related to the present embodiment. FIG. 5B is a partial cross-sectional view showing the blank which becomes the outside of the attached barrel overlap portion of the retort cup related to the present embodiment. FIG. 5C is a partial cross-sectional view showing the attached barrel overlap portion after attachment of the retort cup related to the present embodiment.

Figure 6A:
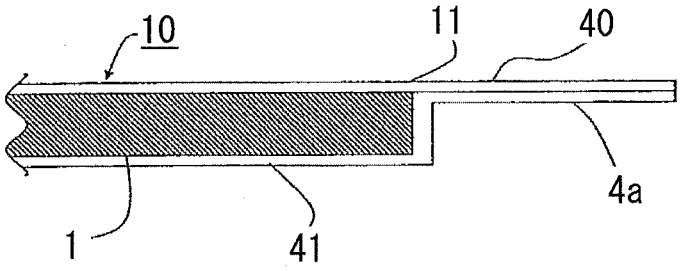
FIG. 6A is a partial cross-sectional view showing a blank which becomes the inside of the attached barrel overlap portion of the retort cup related to the embodiment.
Figure 6B:
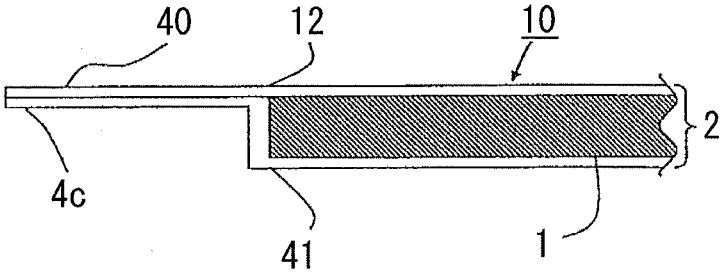
FIG. 6B is a partial cross-sectional view showing the blank which becomes the outside of the attached barrel overlap portion of the retort cup related to the embodiment.
Figure 6C:
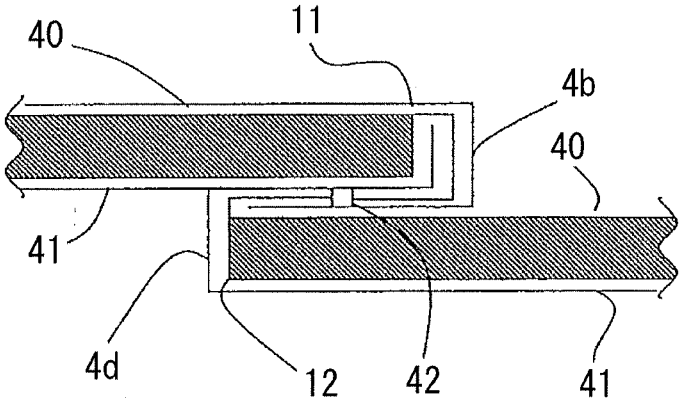
FIG. 6C is a partial cross-sectional view showing the attached barrel overlap portion after attachment of the retort cup related to the embodiment.

FIG. 6A is a partial cross-sectional view showing a blank which becomes the inside of the attached barrel overlap portion of the retort cup related to the present embodiment. FIG. 6B is a partial cross-sectional view showing the blank which becomes the outside of the attached barrel overlap portion of the retort cup related to the present embodiment. FIG. 6C is a partial cross-sectional view showing the attached barrel overlap portion after attachment of the retort cup related to the present embodiment.

In the example shown in FIGS. 5A to 5C, the barrel member blank 10 has a configuration in which one end edge 11 located on the inner surface side of the container in the attached barrel overlap portion 15 includes a fold-back resin portion 4*b*. The fold-back resin portion 4*b* is close to the paper base 1 and formed by folding back the resin portion 4*a* to the outer surface side of the paper base 1. The resin portion 4*a* is formed as the thermoplastic resin layer 40 on the inner surface side of the paper base and the thermoplastic resin layer 41 on the outer surface side of the paper base extends outwardly from the lateral end edges of the paper base 1.

Additionally, in the example shown in FIGS. 6A to 6C, the other end edge 12 located on the outer surface side of the container in the attached barrel overlap portion 15 includes a fold-back resin portion 4*d*. The fold-back resin portion 4*d* is close to the paper base 1 and formed by folding back the resin portion 4*c* to the inner surface side of the paper base 1. The resin portion 4*c* is formed as the thermoplastic resin layer 40 on the inner surface side of the paper base and the thermoplastic resin layer 41 on the outer surface side of the paper base extends outwardly from the lateral end edges of the paper base 1.

As the resin portion 4*b* adopts the configuration in which the resin portion 4*a* is folded back to the outer surface side of the paper base 1 in this way, the amount of resin in the attached barrel overlap portion 15 can be secured, and the sealing performance of the inner surface of the attached portion becomes excellent.

Additionally, as the resin portion 4*d* has the configuration in which the resin portion 4*c* is folded back to the inner surface side of the paper base 1, the amount of resin in the attached barrel overlap portion 15 can be secured, and the sealing performance of the outer surface of the attached portion becomes excellent. Although a resin portion end gap 42 is shown between the end of this resin portion 4*a* and the end of the resin portion 4*c* in FIGS. 6A to 6C, these ends may overlap each other.

Otherwise, the resin portion 4*d* can have a configuration in which the resin portion 4*c* is folded back to the outer surface side of the paper base 1.

Since the retort cup related to the present embodiment has such a structure, the end surface of the paper base located inside the attached barrel overlap portion 15 is protected by the fold-back resin portion 4*b* or the resin portion 4*a* sealed by thermal pressure-bonding if required. Additionally, the end surface of the paper base located outside the attached barrel overlap portion 15 is protected by the fold-back resin portion 4*d* or the resin portion 4*c* sealed by thermal pressure-bonding. As a result, not only do the contents filled into the container not penetrate from the paper base end surfaces, but also the rigidity of the paper base does not become weak even if liquids, such as water, adhere from the outside. As a result, the edge protection effect having excellent water resistance can be obtained.

The retort cup related to the present embodiment uses the structure where such an edge protection effect is obtained for end surface processing of the paper base which constitutes the retort cup. For this reason, the retort cup related to the present embodiment has excellent water resistance because the end surfaces are protected at all points.

Next, an example of a manufacturing method of the retort cup related to the present embodiment, particularly, a manufacturing method of the barrel member blank will be described.

Figure 7A:
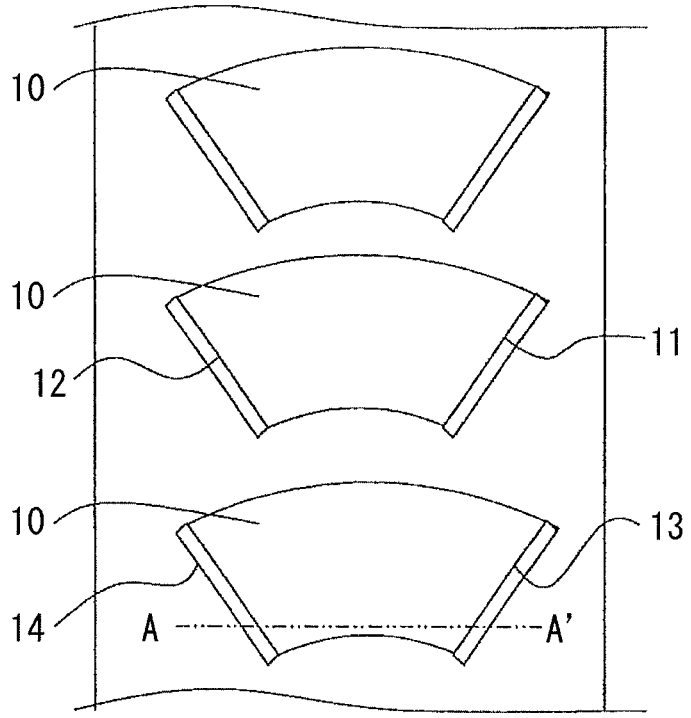
FIG. 7A is a plan view showing a first punching process of providing a long window of a barrel member blank used for the manufacture of the retort cup related to the embodiment.
Figure 7B:
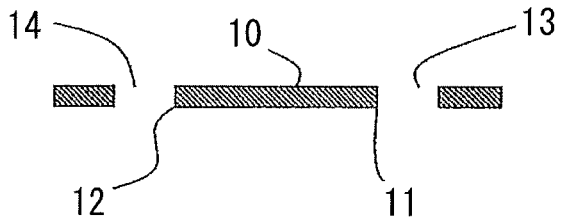
FIG. 7B is a cross-sectional view taken along the line A-A' of FIG. 7A showing the first punching process of providing the long window of the barrel member blank used for the manufacture of the retort cup related to the embodiment.

First, a plurality of sector-shaped barrel member blanks 10 is assigned side by side and printed on a roll-like paper base 1. Additionally, at both end edges 11 and 12 of a barrel member blank 10, outward portions including these end edges are bored as long windows 13 and 14 (refer to FIGS. 7A and 7B).

A laminated sheet is formed by laminating thermoplastic resin layers 40 and 41, such as polyethylene resin, on the inner surface and outer surface of the paper base 1 in which the long windows 13 and 14 are bored by printing the barrel member blank 10, using a melting resin extrusion process. At this time, resin portions 4*a* and 4*c* which become end edge extending pieces are formed on long window portions of the paper base 1 by the two thermoplastic resin layers (refer to FIGS. 8A and 8B).

Otherwise, a laminated sheet is formed by laminating a thermoplastic resin layer 40 which has a barrier layer on the inner surface of the paper base 1 in which the long windows 13 and 14 are bored by printing the barrel member blank 10, and laminating a thermoplastic resin layer 41 which does not include a barrier layer on the outer surface of the paper base. At this time, resin portions 4*a* and 4*c* which become end edge extending pieces are formed on long window portions of the paper base 1 by the two thermoplastic resin layers (refer to FIGS. 8A and 8B).

Otherwise, a laminated sheet is formed by laminating a thermoplastic resin layer 40 on the inner surface of the paper base 1 in which the long windows 13 and 14 are bored by printing the barrel member blank 10, and laminating a thermoplastic resin layer 41 having excellent heat-resistant and wear-resistant properties, such as polyethylene terephthalate or nylon, on the outer surface of the paper base. Thereby, flaws, such as a pinhole which may be generated during cup forming, can be eliminated.

As the above barrier layer, materials having an excellent gas barrier property, such as an aluminum foil, an aluminum vapor-deposited plastic film, an inorganic compound vapor-deposited plastic film, an ethylene polyvinyl alcohol copolymer film, a polyethylene terephthalate film, and a polyamide film, can be used.

Portions which are unnecessary for the barrel member blank 10 in which the long window portions including the resin portions 4*a* and 4*c* are formed are continuously cut from the laminated sheet. The resin portions 4*a* and 4*c* become end edge extending pieces which are provided so as to extend outwardly from the paper base 1.

The plurality of sector-shaped barrel member blanks 10 printed from the laminated sheet from which the unnecessary portions are cut off is punched, and barrel member blanks 10 in which the end edge extending pieces 4*a* and 4*c* are formed over the total length of a joining portion, respectively, are prepared one by one.

Figure 8A:
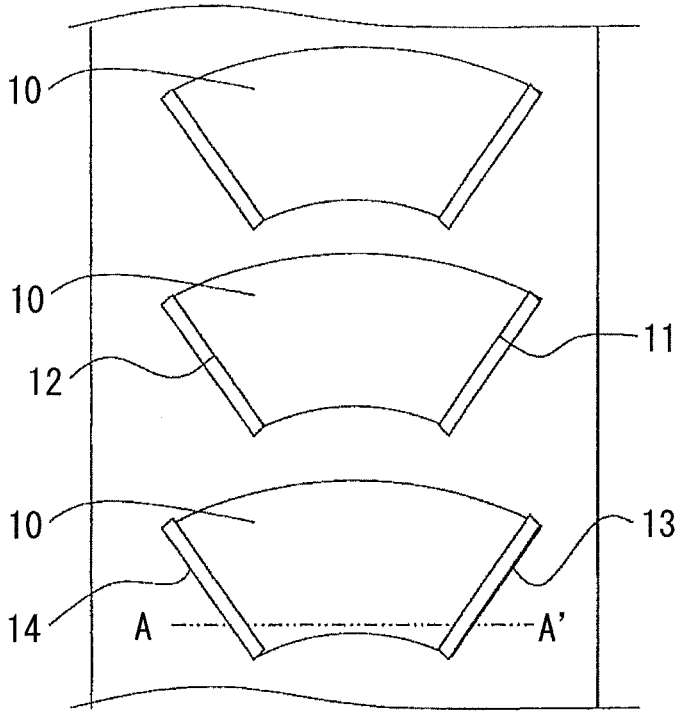
FIG. 8A is a plan view showing a thermoplastic resin attachment process of the barrel member blank used for the manufacture of the retort cup related to the embodiment.
Figure 8B:
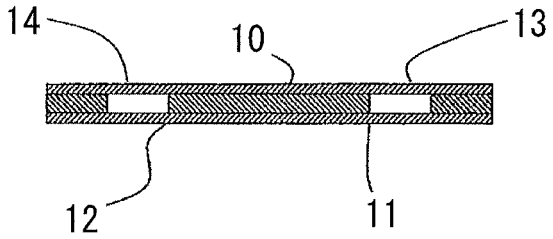
FIG. 8B is a cross-sectional view taken along the line A-A' of FIG. 8A showing a thermoplastic resin attachment process of the barrel member blank used for the manufacture of the retort cup related to the embodiment.

The barrel member blank 10 in which the end edge extending pieces 4*a* and 4*c* extending with a predetermined width externally from the paper base 1 are formed at both lateral end edges can be prepared through such respective processes (refer to FIG. 8A and FIG. 8B).

An example of a forming method of forming a retort cup using the barrel member blank 10 prepared by such a method will be described (refer to FIGS. 1, 3A, and 3B).

The inner base end edge 11 in which the end edge extending piece 4*a* is provided at the end surface of the barrel member blank 10 is placed inside, and the inner base end edge and the outer base end edge 12 provided with the other end edge extending piece 4*c* are overlapped with and joined to each other so as to overlap each other with a predetermined width. Therefore, a cylindrical barrel member (barrel portion) 18 having the attached barrel overlap portion 15 is formed.

The peripheral edge portion 21 of the bottom member (bottom portion) 20 is inserted into the lower inner surface of the tubular barrel member 18 made of the barrel portion forming blank 10. The peripheral edge portion 21 is formed by bending the peripheral edge portion of a bottom portion forming blank downwardly. Next, a lower end 23 of the barrel member 18 is folded back inwardly, and the upper portion thereof is folded back inwardly. Therefore, the lower end 18 of the barrel member is brought into the state of being located between the upper fold-back portion 24 and the downwardly bent portion of the bottom member 20 (FIG. 3A). In this state, the annular leg 22 is formed by bringing the lower end 23 and upper fold-back portion 24 of the barrel member 18 into close contact with the downwardly bent portion (not shown) of the bottom member and joining the lower end and upper fold-back portion of the barrel member to the inner surface of the peripheral edge portion 21 of the bottom member 20 by heat sealing (FIG. 3B).

As a result, the bottom portion structure of the retort cup which can effectively prevent penetration of moisture from the lower end edge of the barrel member 18 is obtained.

Finally, the retort cup related to the present embodiment is obtained by winding the upper peripheral edge of the barrel member 18 outwardly one round or more to form the flange portion 16.

The flange portion 16 is not limited only to the configuration in which the upper peripheral edge is wound outwardly one round or more as described above.

The top surface of the flange portion 16 may be flat by being pressed and pressure-bonded from above and below.

Here, the barrel member 18 uses the barrel member blank 10 in which the cutout portions 31 and 32 are respectively provided in the upper portions of both lateral end edges. For this reason, when the upper peripheral edge of the barrel member 18 is wound outwardly one round or more to form the flange portion 16, even at the attached portion 15, the paper base 1 is brought into a wound state with the same overlap as portions other than the attached portion 15. As a result, the level difference of the flange portion 16 can be eliminated.

The retort cup related to the present embodiment can be decorated by a well-known method. For example, a retort cup can be manufactured, using as the barrel portion blank a paper base in which an ornamental layer is provided on the surface of the paper base by ordinary gravure or offset printing. Otherwise, a retort cup can be manufactured using a laminated material in which a plastic film provided with an ornamental layer and/or a metal vapor-deposited layer by printing or the like is laminated on the surface side of the paper base.

Otherwise, a plastic film which gives an ornamental layer can be covered on the surface of a barrel portion of a formed retort cup by printing or metal vapor deposition.

(2) Second Embodiment

A cup-like paper container related to a second embodiment of the invention will be described below with reference to the drawings.

The paper container related to the present embodiment is made up of, for example, a laminated sheet based on paper which has thermoplastic resin layers provided on the inner and outer surfaces thereof.

Figure 10:
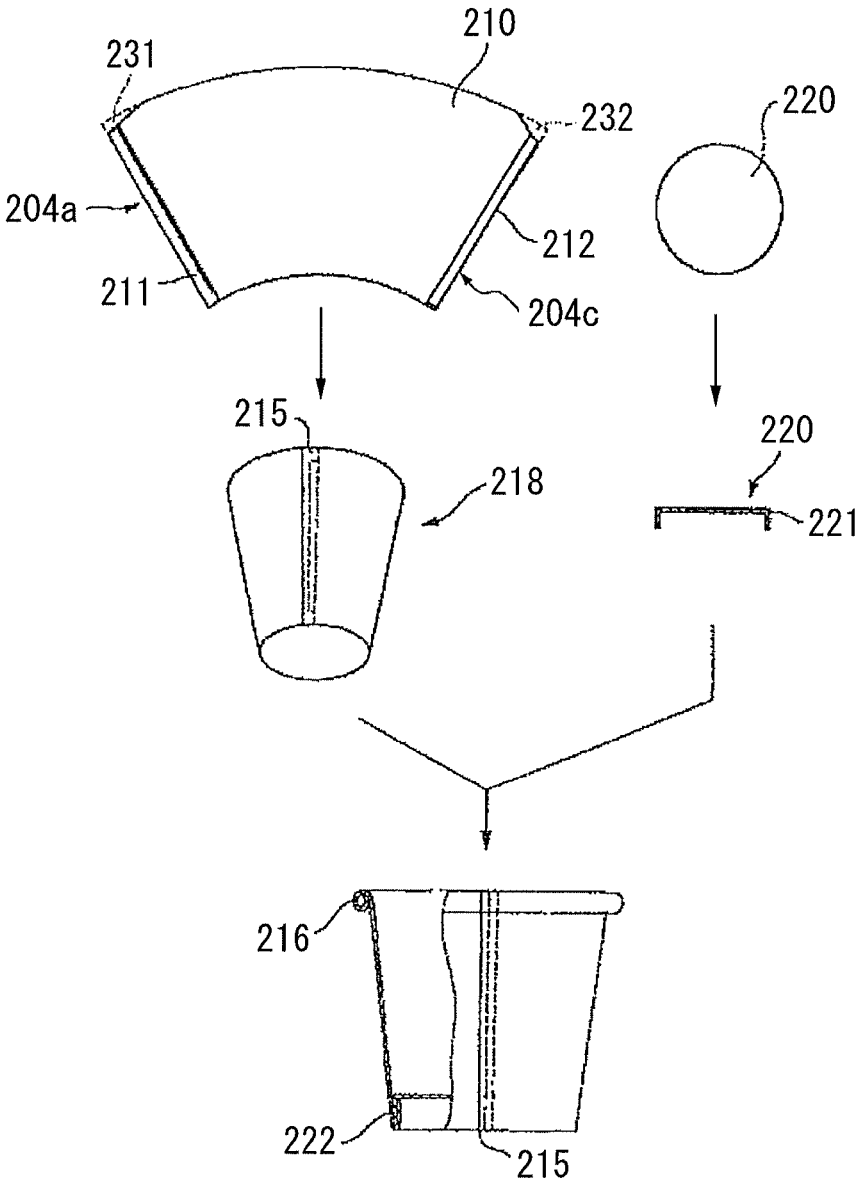
FIG. 10 is a schematic view showing a manufacturing process of a cup-like container related to a second embodiment of the invention.

FIG. 10 is a schematic view showing a manufacturing process of the cup-like container related to the present embodiment.

As shown in FIG. 10, a barrel member 218 is formed in a cylindrical shape which has an attached barrel overlap portion 215. The attached barrel overlap portion 215 is formed such that one end edge 211 of the barrel member blank 210 is overlapped with the other end edge 212. Cutout portions 231 and 232 are respectively provided in upper portions of both lateral end edges of the barrel member blank 210. Additionally, a bottom member 220 has a circular shape and has a peripheral edge portion 221 which is erected downwardly. The outer surface of the peripheral edge portion 221 of the bottom member 220 is joined to the lower inner surface of the barrel member 218.

Moreover, the lower end edge of the barrel member 218 is bent downwardly so as to cover the peripheral edge portion 221 and is joined to the inner surface of the peripheral edge portion 221 of the bottom member, whereby an annular leg 222 is formed. A flange portion 216 is formed by winding the upper peripheral edge of the barrel member 218 outwardly one round or more. The cup-like paper container cup is formed in this way.

In addition, such a structure is not limited only to the tapered cup-like paper container, and may be a cylindrical cup-like paper container. Moreover, the basic structure of the following joining portion is the same even in a paper container which requires the edge protection of the paper base joining portion against penetration or the like of moisture from the contents or the external environment.

Figure 11A:
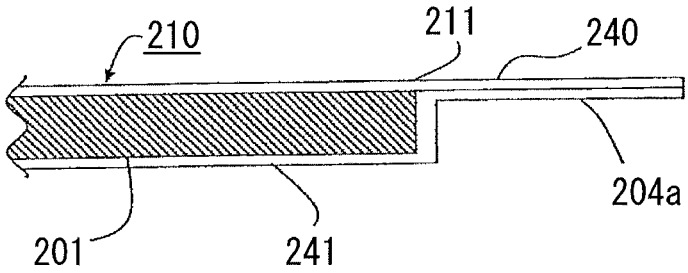
FIG. 11A is a partial cross-sectional view showing a blank which becomes the inside of an attached barrel overlap portion of a retort cup related to the above embodiment.
Figure 11B:
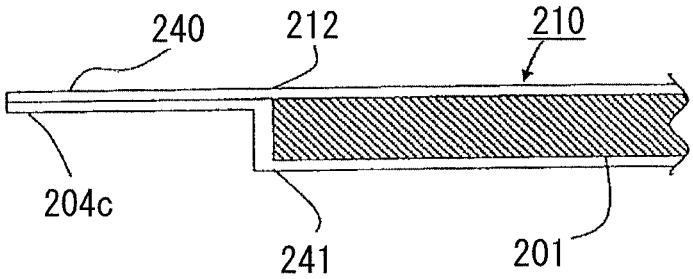
FIG. 11B is a partial cross-sectional view showing the blank which becomes the outside of the attached barrel overlap portion of the retort cup related to the embodiment.
Figure 11C:
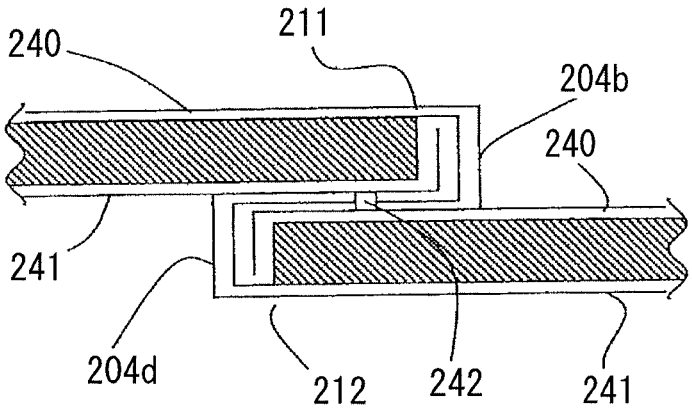
FIG. 11C is a partial cross-sectional view showing the attached barrel overlap portion after attachment of the retort cup related to the embodiment.

FIG. 11A is a partial cross-sectional view showing a blank which becomes the inside of the attached barrel overlap portion of the retort cup related to the present embodiment. FIG. 11B is a partial cross-sectional view showing the blank which becomes the outside of the attached barrel overlap portion of the retort cup related to the present embodiment. FIG. 11C is a partial cross-sectional view showing the attached barrel overlap portion after attachment of the retort cup related to the present embodiment.

Figure 12A:
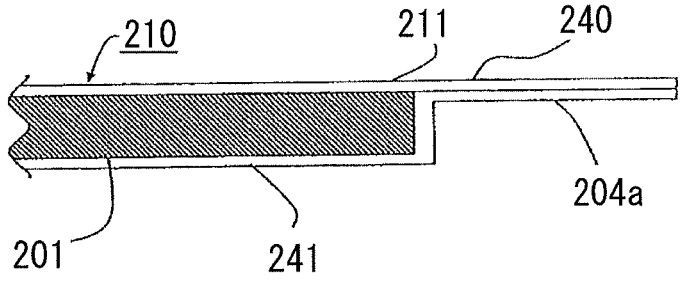
FIG. 12A is a partial cross-sectional view showing a blank which becomes the inside of the attached barrel overlap portion of the retort cup related to the embodiment.
Figure 12B:
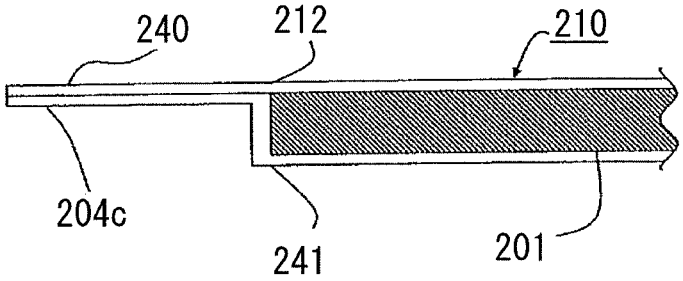
FIG. 12B is a partial cross-sectional view showing the blank which becomes the outside of the attached barrel overlap portion of the retort cup related to the embodiment.
Figure 12C:
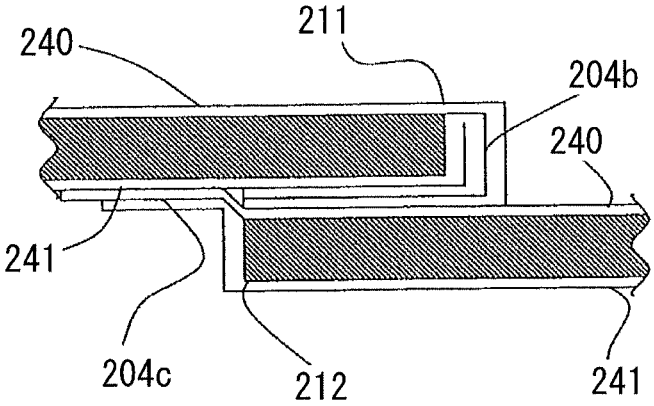
FIG. 12C is a partial cross-sectional view showing the attached barrel overlap portion after attachment of the retort cup related to the embodiment.

FIG. 12A is a partial cross-sectional view showing a blank which becomes the inside of the attached barrel overlap portion of the retort cup related to the present embodiment. FIG. 12B is a partial cross-sectional view showing the blank which becomes the outside of the attached barrel overlap portion of the retort cup related to the present embodiment. FIG. 12C is a partial cross-sectional view showing the attached barrel overlap portion after attachment of the retort cup related to the present embodiment.

As shown in FIGS. 11A to 11C, the barrel member blank 210 includes a configuration having a resin portion (end edge extending portion) 204*a*, which is formed as a thermoplastic resin layer 240 on the side of a paper base inner surface and a thermoplastic resin layer 241 on the side of a paper base outer surface extend outwardly from a lateral end edge of the paper base 201, in the inner end edge 211 located on the inner surface side of the container in the attached barrel overlap portion 215, and a fold-back resin portion 204*b* which is close to the paper base 201 and formed as the thermoplastic resin layers are folded back to the outer surface side of the paper base 201.

Additionally, the barrel member blank includes a configuration having a resin portion (end edge extending portion) 204*c*, which is formed as the thermoplastic resin layer 240 on the side of the paper base inner surface and the thermoplastic resin layer 241 on the side of the paper base outer surface extend outwardly from a lateral end edge of the paper base 201, in the other end edge 212 located on the inner surface side of the container in the attached barrel overlap portion 215, and a fold-back resin portion 204*d* which is close to the paper base 201 and formed as the thermoplastic resin layers are folded back to the inner surface side of the paper base 201.

As the resin portion 204*b* has the configuration in which the resin portion 204*a* is folded back to the outer surface side of the paper base 201 in this way, the amount of resin in the attached barrel overlap portion 215 can be secured. As a result, the sealing performance of the inner surface of the attached portion becomes excellent.

Additionally, as the resin portion 204*d* has the configuration in which the resin portion 204*c* is folded back to the inner surface side of the paper base 201 in this way, the amount of resin in the attached barrel overlap portion 215 can be secured. As a result, the sealing performance of the outer surface of the attached portion becomes excellent. Although a resin portion end gap 242 is shown between the end of this resin portion 204*a* and the end of the resin portion 204*c* in FIGS. 11A to 11C, these ends may overlap each other.

Otherwise, the resin portion 204*d* can have a configuration in which the resin portion 204*c* is folded back to the outer surface side of the paper base 201.

Moreover, according to the degree of necessity for edge protection regarding the outside of the attached barrel overlap portion 15, as shown in FIGS. 12A to 12C, the thermoplastic resin layer 240 on the inner surface side of the paper base and the thermoplastic resin layer 241 on the outer surface side of the paper base, in the other end edge 212 of the paper base located on the outer surface side of the container in the attached barrel overlap portion 215, can also have a configuration in which the resin portion 204*c* which extends outwardly from the lateral end edge/of the paper base 201 is brought into close contact with and pressure-bonded on the thermoplastic resin 241 on the outer surface side of the paper base 201 on the side of the inner surface of the container.

Since cup-like paper container related to the present embodiment has such a structure, the end surface of the paper base 201 located inside the attached barrel overlap portion 215 is protected by the fold-back resin portion 204*b*. Additionally, the end surface of the paper base 201 located outside the attached barrel overlap portion 215 is protected by the fold-back resin portion 204*d* or the resin portion 204*c* sealed by thermal pressure-bonding if required. Thereby, not only do the contents filled into the container not penetrate from the paper base end surfaces, but also the edge protection effect of preventing penetration from the outside of the container is obtained.

By providing the thermoplastic resin layers 240 and 241 on both surfaces of the paper base in this way, the resin portions 204*a* and 204*c* which extend outwardly to the base end surfaces are formed, with the thermoplastic resin layers 240 and 241 on both the surfaces being integrated at the outer edges. The resin portions 204*a* and 204*c* may have a configuration in which separate members (for example, tapes) are provided at the ends of the base, and are integrated at the outer edges similarly to the above description, instead of the configuration in which the resin portions are formed by the thermoplastic resin layers 240 and 241 provided on both surfaces of the paper base 201.

Additionally, the resin portions 204*a* and 204*c* may have a configuration in which one side is a thermoplastic resin layer provided on the paper base 201, the other is a tape, and these are integrated at the outer edges similarly to the above description.

The resin portion 204*a* may have a configuration having the fold-back resin portion 204*b* which is folded back to the outer surface side of the paper base 201, instead of the configuration in which the resin portion extends from the end edge of the paper base 201 outwardly as mentioned above. The resin portion 204*c* may have a configuration in which the resin portion extends outwardly from the end edge of the paper base and is thermally pressure-bonded, or having the fold-back resin portion 204*d* which is folded back to the outer surface side or inner surface side of the paper base.

In this way, the level difference of the attached barrel overlap portion 215 is filled by the fold-back resin portion 204*b* by the configuration in which the attachment resin portion 215 of the barrel member 218 has the fold-back resin portion 204*b* which is folded back to the outer surface side or inner surface side of the paper base 201. As a result, not only a configuration with no level difference can be adopted, but also a configuration in which the end surfaces of the paper base 201 are not exposed to the inside of the paper container may be adopted.

Additionally, the level difference of the attached barrel overlap portion 215 is filled by the outwardly extend resin portion 204*c* by the configuration in which the resin portion 204*c* extends outwardly from the end edge of the paper base 201 and is thermally pressure-bonded. As a result, not only a configuration with no level difference can be adopted, but also a configuration in which the paper base 201 is not exposed to the outside of the paper container may be adopted.

Additionally, the level difference of the attached barrel overlap portion 215 is filled by the fold-back resin portion 204*d* by the configuration in which the resin portion 204*c* has the fold-back resin portion 204*d* which is folded back to the outer surface side of the paper base 201 from the end edge of the paper base 201. As a result, not only a configuration with no level difference can be adopted, but also a configuration in which the end surfaces of the paper base 201 are not exposed to the outside of the paper container may be adopted.

Generally, the cup-like paper container related to the present embodiment is provided with the flange portion 216. A barrel member blank 210 in which the cutout portions 231 and 232 are respectively provided in the upper portions of both lateral end edges is used. As a result, when the upper peripheral edge of the barrel member is wound outwardly one round or more to form the flange portion 216 with at least three-fold configuration, even at the upper end of the attached portion 215 of the barrel member 218, the paper base is brought into a wound state with the same three-fold configuration as portions other than the attached portion.

Here, by forming the cutout portions 231 and 232 in different shapes, the level difference of the top surface of flange portion 216 caused at the position of the attached portion 215 can be eliminated even if the top surface of the flange portion 216 with at least a three-fold configuration is made flat.

In the paper container related to the present embodiment, the thermoplastic resin layer 240 may be configured to have a layer including a barrier layer. Through the configuration including the barrier layer 202*a* in this way, the end surfaces of the paper base 201 is protected by the barrier layer. Therefore, the cup-like paper container having an excellent barrier property can be provided.

Figure 18A:
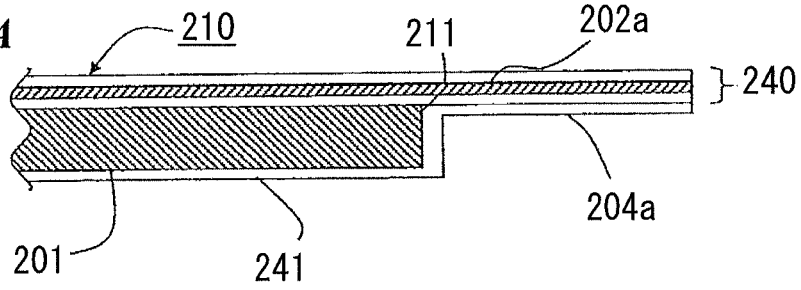
FIG. 18A is a partial cross-sectional view showing a blank which becomes the inside of the attached barrel overlap portion of the retort cup related to the embodiment.
Figure 18B:
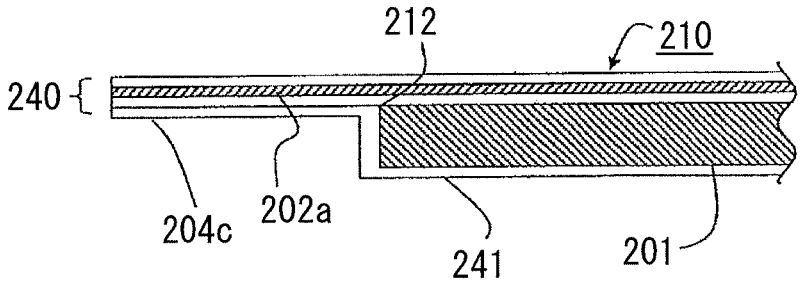
FIG. 18B is a partial cross-sectional view showing the blank which becomes the outside of the attached barrel overlap portion of the retort cup related to the embodiment.
Figure 18C:
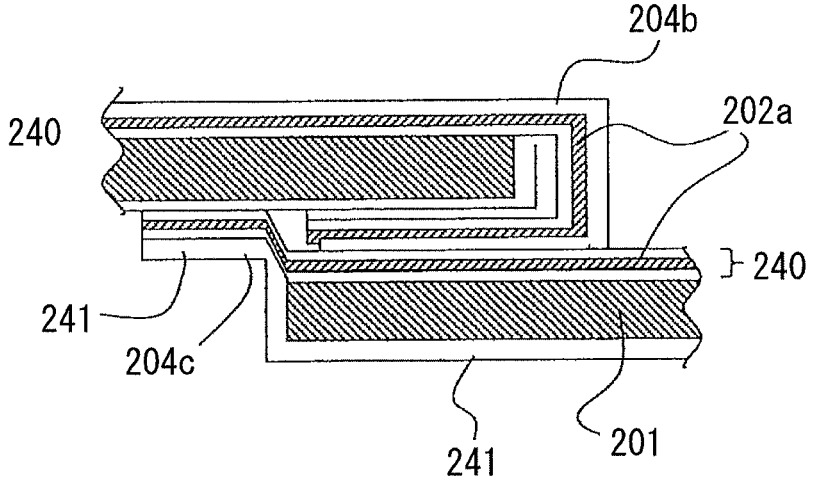
FIG. 18C is a partial cross-sectional view showing the attached barrel overlap portion after attachment of the retort cup related to the embodiment.

Additionally, as shown in FIGS. 18A to 18C, the end surfaces of the barrier layer 202*a* are not exposed to the inside of the container by the configuration in which the resin portion 204*a* including the barrier layer has the fold-back resin portion 204*b*. Therefore, since contents do not come into contact with the barrier layer, preservation of contents is not affected.

The fold-back resin portions 204*b* and 204*d* have a configuration in which the tips of the resin portions are folded back to the outer surface side of the paper base 201 inside the attached portion 215 or the outer surface side or inner surface side of the paper base 201 outside the attached portion 215. For this reason, even in a configuration in which the thermoplastic resin layer 240 includes the barrier layer 202*a* made of a different material, a constant amount of resin for attachment can be secured in the attached barrel overlap portion 215 when the barrel portion is formed. As a result, as well as the protection of the end surfaces of the paper base 201, the level difference of the attached barrel overlap portion 215 cased by the paper base 201 can be eliminated.

Additionally, the configuration in which the thermoplastic resin layer 241, such as polyethylene, is provided on the outer surface of the paper base 201, and the thermoplastic resin layer 240 is provided on the inner surface of the paper base 201 is adopted. Therefore, since the inner surfaces of the tips of the thermoplastic resin layers 240 and 241 on both the surfaces are integrated, the resin portions 204*a* and 204*c* which seal the end surfaces of the paper base 201 can be formed by simple thermal pressure-bonding.

Particularly, the resin portion 204*c* is formed at the end of the paper base 201 bonded to the outside of the attached barrel overlap portion 215 by the thermoplastic resin layers 240 and 241 on both the surfaces. If there is no necessity of preventing penetration of moisture or the like from the outside of the container, this resin portion 204*c* is brought into close contact with and fixed to the resin portion 204*b* or thermoplastic resin layer 241 formed at the end of the inner paper base 201 after being formed by simple thermal pressure-bonding. As a result, required end protection can be performed, a constant amount of resin can be treated at a bonded portion, and when the barrel portion is formed, the level difference of the attached barrel overlap portion 215 can be eliminated.

By adopting a configuration in which the resin portion of the inner paper base end is folded back, a configuration in which the end surfaces of the barrier layer 202*a* are not exposed to the inside of the container is provided. Through this configuration, contents do not come into contact with the barrier layer even in a configuration in which the thermoplastic resin layer 240 includes the barrier layer 202*a* made of a different material. For this reason, preservation of contents is not affected. Since the rigidity of the paper base does not become weak even if liquids, such as water, adhere from the outside, the cup-like paper container having excellent water resistance can be provided.

In addition, such a structure is not limited only to the tapered cup-like paper container, and may be a cylindrical cup-like paper container. Additionally, such a structure can be used for a paper container which requires edge protection of the attached portion.

Next, a manufacturing method of the barrel member blank in the manufacturing method of the paper container related to the present embodiment will be described.

Figure 13A:
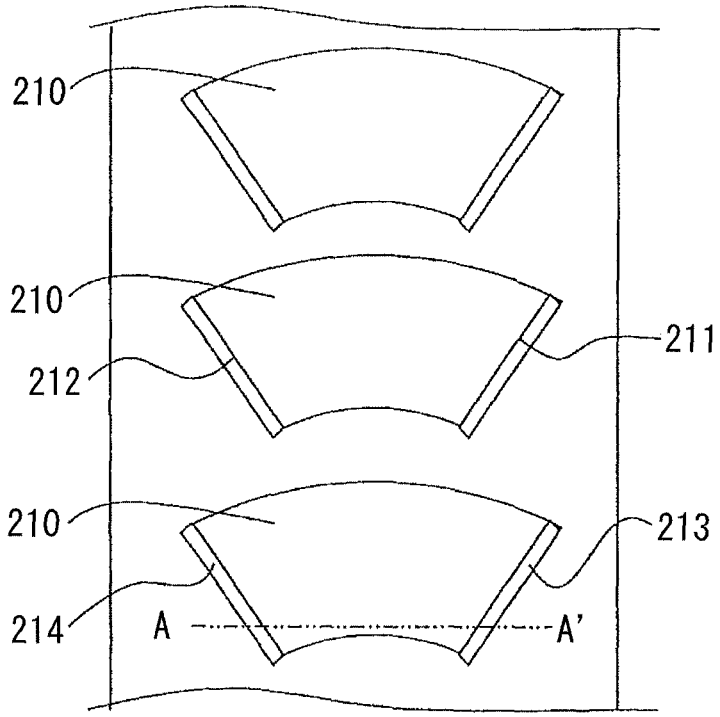
FIG. 13A is a plan view showing a first punching process of providing a long window of a barrel member blank used for the manufacture of the cup-like paper container related to the embodiment.
Figure 13B:
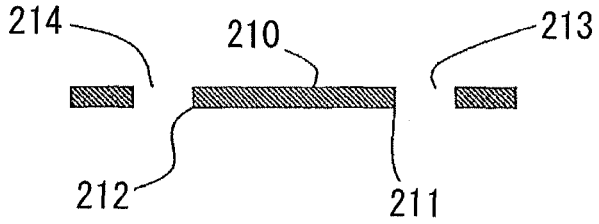
FIG. 13B is a cross-sectional view taken along the line A-A' of FIG. 13A showing the first punching process of providing the long window of the barrel member blank used for the manufacture of the cup-like paper container related to the embodiment.

First, a plurality of sector-shaped barrel member blanks 210 is assigned side by side and printed on a roll-like paper base 201. At both end edges 211 and 212 of a barrel member blank 210, outward portions including these end edges are bored as long windows 213 and 214 (refer to FIGS. 13A and 13B) (first punching process).

Figure 14A:
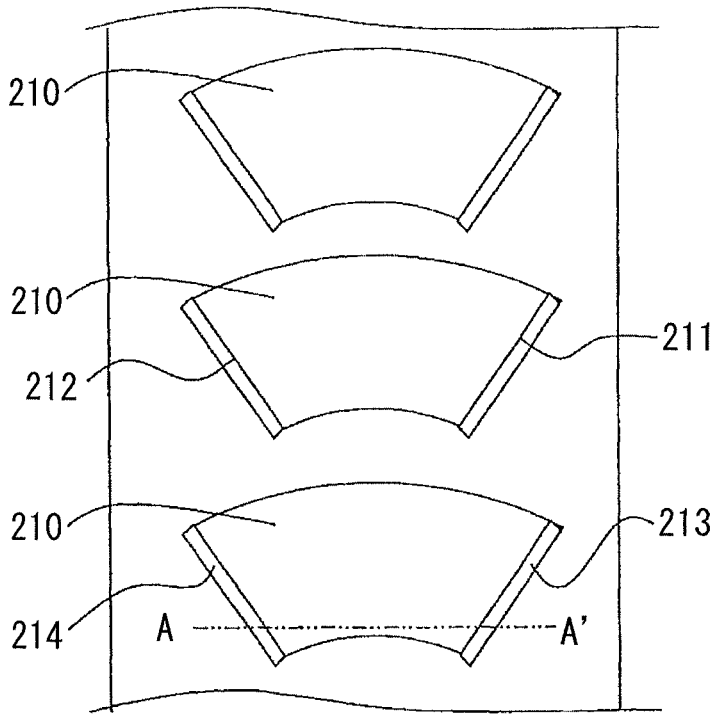
FIG. 14A is a plan view showing a thermoplastic resin attachment process of the barrel member blank used for the manufacture of the cup-like paper container related to the embodiment.
Figure 14B:
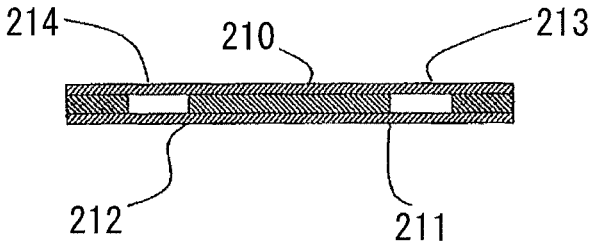
FIG. 14B is a cross-sectional view taken along the line A-A' of FIG. 14A showing a thermoplastic resin attachment process of the barrel member blank used for the manufacture of the cup-like paper container related to the embodiment.

A laminated sheet 203 is formed by laminating the thermoplastic resin layers 240 and 241, such as polyethylene resin, on the inner surface and outer surface of the paper base 201 in which the long windows 213 and 214 are bored by printing the barrel member blank 210, using a melting resin extrusion process. At this time, resin portions 204*a* and 204*c* are formed on long window portions of the paper base 201 by the two thermoplastic resin layers (refer to FIGS. 14A and 14B) (thermoplastic resin attachment process).

Otherwise, a laminated sheet 203 is formed by laminating a thermoplastic resin layer 240 which has a barrier layer 202*a* on the inner surface of the paper base 201 in which the long windows 213 and 214 are bored by printing the barrel member blank 210, and laminating a thermoplastic resin layer 241 which does not include a barrier layer on the outer surface of the paper base. At this time, resin portions 204*a* and 204*c* are formed on long window portions of the paper base 201 by the two thermoplastic resin layers (refer to FIGS. 14A and 14B) (thermoplastic resin attachment process).

As the above barrier layer 202*a*, materials having an excellent gas barrier property, such as an aluminum foil, an aluminum vapor-deposited plastic film, an inorganic compound vapor-deposited plastic film, an ethylene polyvinyl alcohol copolymer film, a polyethylene terephthalate film, and a polyamide film, can be used.

Figure 15A:
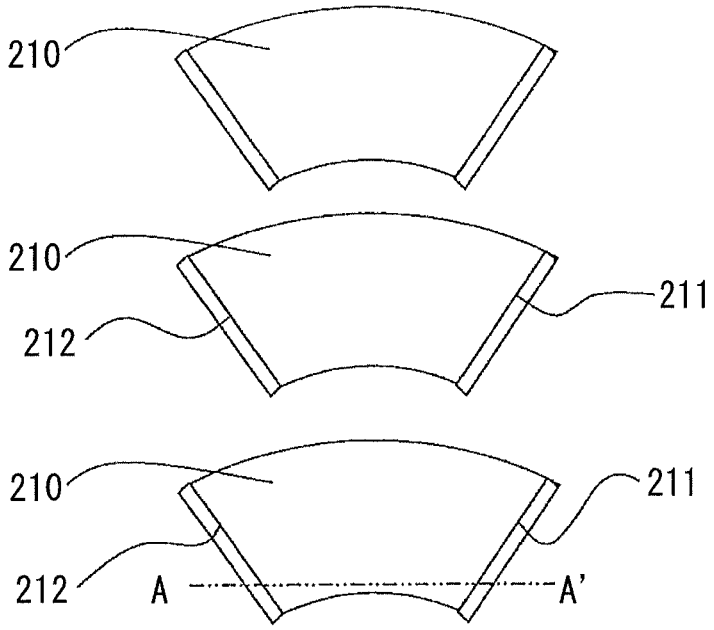
FIG. 15A is a plan view showing a second punching process of the barrel member blank used for the manufacture of the cup-like paper container related to the embodiment.
Figure 15B:
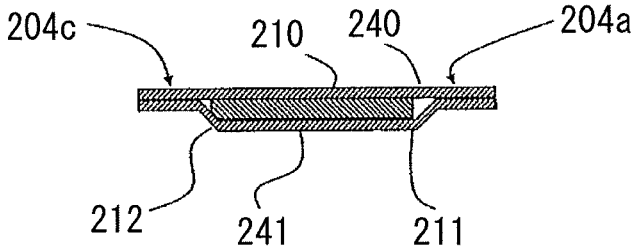
FIG. 15B is a cross-sectional view taken along the line A-A' of FIG. 15A showing the second punching process of the barrel member blank used for the manufacture of the cup-like paper container related to the embodiment.

Portions which are unnecessary for the barrel member blank 210 in which the long window portions including the resin portions 204*a* and 204*c* which are provided so as to extend outwardly from the paper base 201 are formed are continuously cut from the laminated sheet 203 (refer to FIGS. 15A and 15B) (scrap cutting process). The barrel member blank 210 is formed with long window portions including the resin portions 204*a* and 204*c* provided so as to extend outwardly from the paper base 201.

The plurality of sector-shaped barrel member blanks 210 printed from the laminated sheet 203 from which the unnecessary portions are cut off is punched, and barrel member blanks 210 in which the resin portions 204*a* and 204*c* are formed are prepared one by one (FIGS. 15A and 15B) (second punching process).

The barrel member blank 210 in which the resin portions 204*a* and 204*c* extending with a predetermined width externally from the paper base 201 are formed at both lateral end edges can be prepared through such respective processes.

Next, a method of bringing the resin portion 204*a* of the barrel member blank 210 into close contact with the paper base end surfaces and forming the fold-back resin portion 204*b* will be described with reference to FIGS. 16, 17A to 17D.

Figure 16:
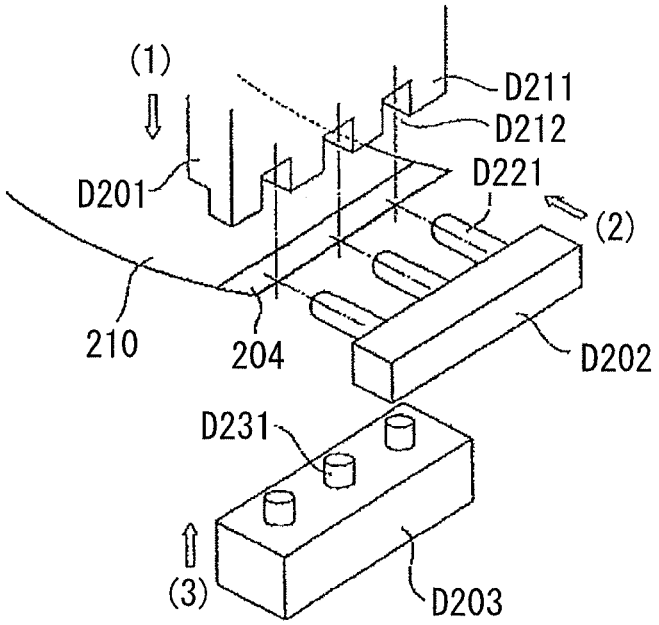
FIG. 16 is a perspective view showing an example of a temporary bonding mechanism which bends and temporarily bonds the resin portion related to the embodiment to the outer surface side of a paper base.

FIG. 16 is a perspective view showing an example of a temporary bonding mechanism which bends and temporarily bonds the resin portion related to the present embodiment to the outer surface side of the paper base.

FIGS. 17A to 17D are partial cross-sectional views showing the process of bending and temporarily bonding the resin portion related to the present embodiment to the outer surface side of the paper base.

The method of bringing the resin portion 204*c* into close contact with the paper base end surfaces, and forming the fold-back resin portion 204*d* is also the same. The method when the resin portion 204*c* is pressure-bonded at a portion extending with a predetermined width outwardly from the paper base end surface is a process simpler than the method of forming the fold-back resin portion 204*d*. Hence, the description of this method is omitted.

Figure 17A:
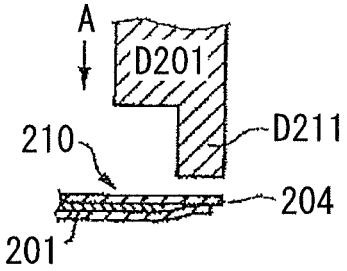
FIG. 17A is a partial cross-sectional view showing the process of bending and temporarily bonding the resin portion related to the embodiment to the outer surface side of the paper base.
Figure 17B:
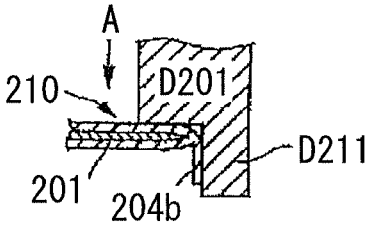
FIG. 17B is a partial cross-sectional view showing the process of bending and temporarily bonding the resin portion related to the embodiment to the outer surface side of the paper base.
Figure 17C:
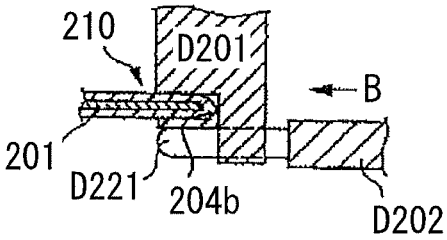
FIG. 17C is a partial cross-sectional view showing the process of bending and temporarily bonding the resin portion related to the embodiment to the outer surface side of the paper base.

The resin layer 204*a* is pushed and bent and is temporarily folded back at an angle of about 90° toward the side which becomes the outer surface side of the paper base 201 when a retort cup is formed, by moving a first member D201 in a vertical direction downwardly from the above (refer to FIGS. 17A and 17B). The resin layer 204*a* extends by a predetermined width from the paper base 201 which becomes the inside of the attached portion 215 of the barrel member blank 210. The first member D201 includes a presser projection D211 which is formed in the shape of a comb.

Next, a second member D202 is horizontally moved inwardly from the outside of the barrel member blank 210, toward a gap D212 between the presser projection D211 and presser projection D211 of the first member D201. Thereafter, the resin layer 204*a* is pushed and bent at about 90°, and thereby temporarily folded back such that the resin layer 204*a* overlaps in the direction opposite to the surface of the paper base 201 of the barrel member blank 210 including the fold-back resin portion 204*b* (refer to FIG. 17C). The second member D202 includes a presser projection D221 which is formed in the shape of a comb.

Figure 17D:
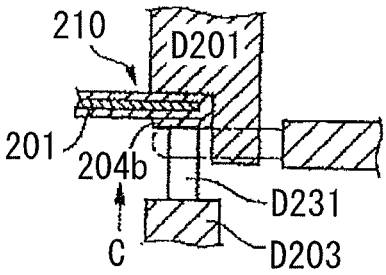
FIG. 17D is a partial cross-sectional view showing the process of bending and temporarily bonding the resin portion related to the embodiment to the outer surface side of the paper base.

Finally, the fold-back resin portion 204*b* is temporarily bonded to the outer surface side of the paper base 201 of the barrel member blank 210 by pushing and pressing a third member D203 vertically upward (refer to FIG. 17D). The third member D203 is arranged below the first member D201, and includes a presser projection D231 which is formed in the shape of a comb.

Even in the paper base 201 which becomes the outside of the attached portion 215, if required, the fold-back resin portion 204*d* can be formed similarly.

In addition, if the presser projection D231 of the third member D203 is heated to a proper temperature, the bonding property of the resin portion is improved, which is more effective.

Additionally, when the fold-back portion is not required, this apparatus can be used to perform sealing of the paper base end surfaces by simple pressure-bonding.

An example of a forming method of forming a cup-like paper container using the barrel member blank 210 prepared by such a method will be described (refer to FIG. 10).

The lateral end edge 211 in which the fold-back resin portion 204*b* is provided on the end surface of the barrel member blank 210 is turned to the inner surface side, and this lateral end edge is overlapped with and joined to the lateral end edge 212 provided with the other fold-back resin portion 204*d*, therefore forming the cylindrical barrel member 218 having the attached barrel overlap portion 215.

The outer surface of the peripheral edge portion 221 of the bottom member 220 is joined to the lower inner surface of the barrel member 218. Moreover, the lower end edge of the barrel member 218 is bent downwardly so as to cover the peripheral edge portion 221 and is joined to the inner surface of the peripheral edge portion 221 of the bottom member, whereby an annular leg 222 is formed.

Finally, a flange portion 216 is formed by winding the upper peripheral edge of the barrel member 218 outwardly one round or more. The cup-like paper container cup related to the present embodiment is formed in this way.

The flange portion 216 may have a configuration in which the flange portion 216 is pressed and pressure-bonded from above and below and the top surface thereof is made flat, instead of the configuration in which the upper peripheral edge is wound outwardly one round or more as mentioned above.

Since the barrel member 218 uses the barrel member blank 210 in which the cutout portions 231 and 232 respectively provided in upper portions of both end edges, when the upper peripheral edge of the barrel member 218 is wound outwardly one round or more to form the flange portion 216, even at the attached portion 215, the paper base 201 is brought into a wound state with the same overlap as portions other than the attached portion 215. For this reason, the level difference of the flange portion 216 can be eliminated.

The paper container related to the present embodiment can be decorated by a well-known method. For example, a paper container can be manufactured, using, as the barrel portion blank 210, a paper base 201 in which an ornamental layer is provided on the surface of the paper base 201 by ordinary gravure or offset printing. Otherwise, a retort cup can be manufactured using a laminated material in which a plastic film provided with an ornamental layer and/or a metal vapor-deposited layer by printing or the like is laminated on the surface side of the paper base 201.

Otherwise, a plastic film which gives an ornamental layer can be covered on the surface of a barrel portion of a formed paper container by printing or metal vapor deposition.

(3) Third Embodiment

A retort cup related to a third embodiment of the invention will be described below with reference to the drawings.

The retort cup related to the present embodiment is made up of, for example, a laminated sheet 403 based on a paper layer 401 which has a thermoplastic resin layer 440 provided at least on the inner surface thereof.

Figure 19:
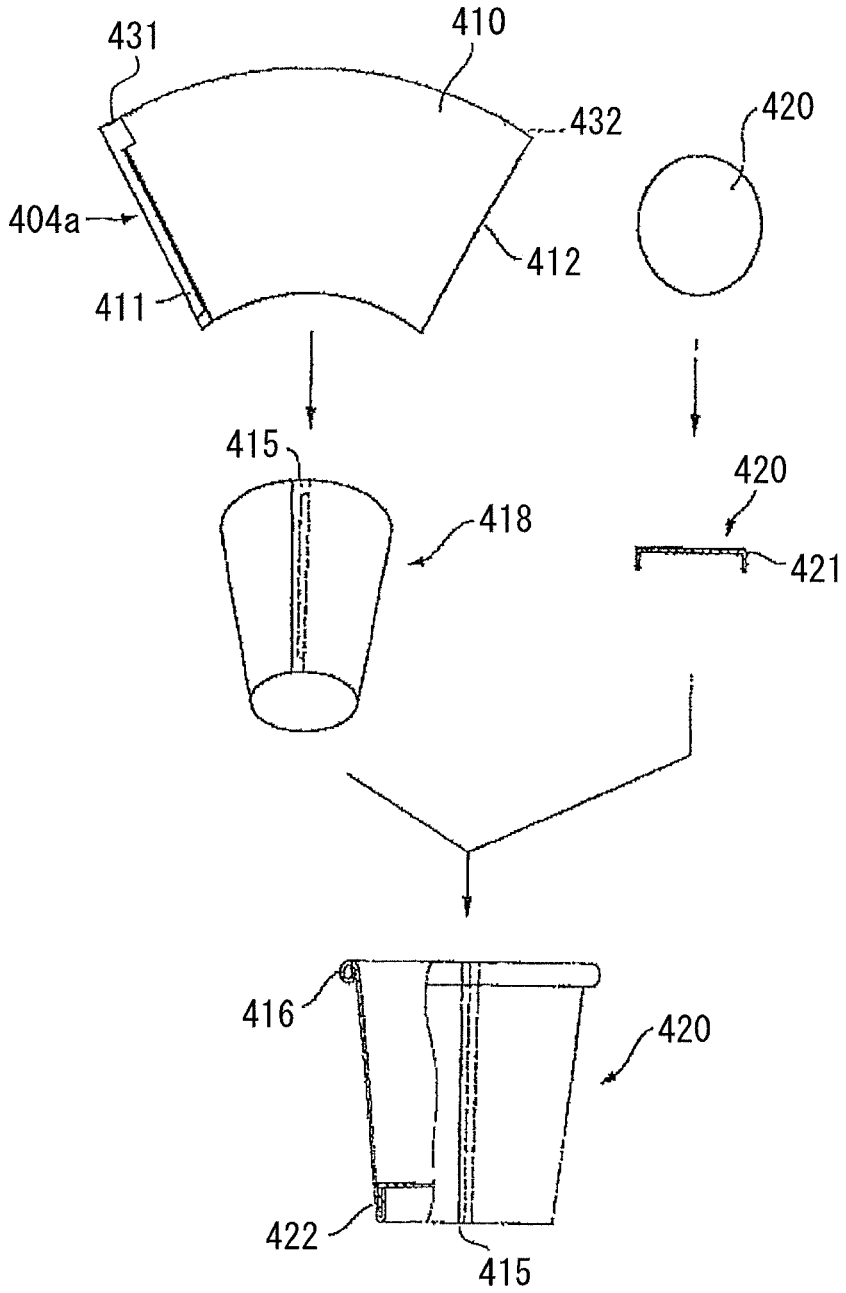
FIG. 19 is a schematic view showing a manufacturing process of a retort cup related to a third embodiment of the invention.

FIG. 19 is a schematic view showing a manufacturing process of the retort cup related to the present embodiment.

The retort cup related to the present embodiment is made up of a barrel member 418 and a bottom member 420. The barrel member 418 is formed in a substantially cylindrical shape having an attached barrel overlap portion 415 in which one end edge 411 of the barrel member blank 410 is overlapped with one end edge 412. A cutout portion 431 is provided in an upper portion of a lateral end edge of the barrel member blank 410. The bottom member 420 has a circular shape and has a peripheral edge portion 421 which is erected downwardly.

The outer surface of the peripheral edge portion 421 of the bottom member 420 is joined to the lower inner surface of the barrel member 418.

Moreover, the lower end edge of the barrel member 418 is bent downwardly so as to cover the peripheral edge portion 421 and is joined to the inner surface of the peripheral edge portion 421 of the bottom member, whereby an annular leg 422 is formed.

On the other hand, a flange portion 416 is formed by winding the upper peripheral edge of the barrel member outwardly one round or more. The retort cup is formed in this way.

In addition, such a structure is not limited only to the tapered retort cup, and may be a cylindrical cup-like paper container.

Figure 24A:
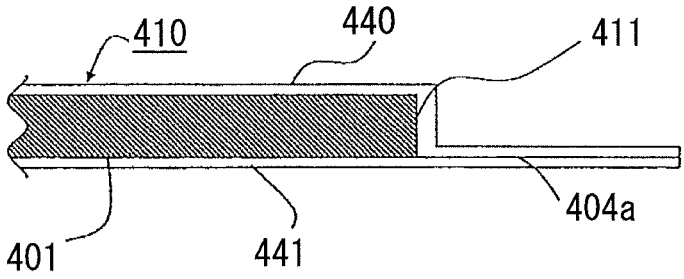
FIG. 24A is a partial cross-sectional view showing a blank which becomes the inside of the attached barrel overlap portion of the retort cup related to the embodiment.
Figure 24B:
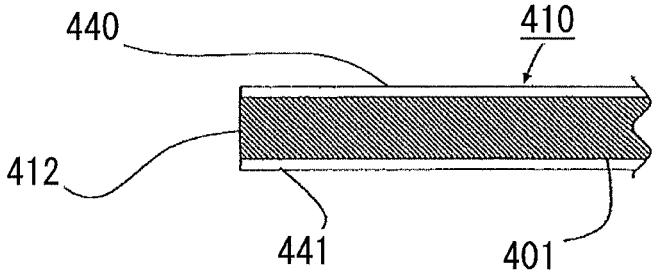
FIG. 24B is a partial cross-sectional view showing the blank which becomes the outside of the attached barrel overlap portion of the retort cup related to the embodiment.
Figure 24C:
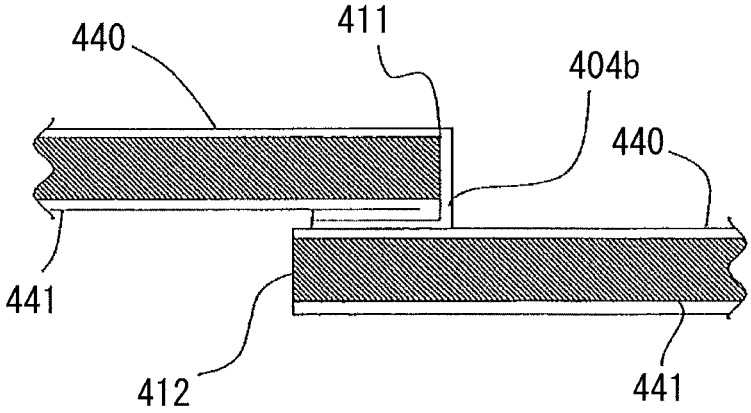
FIG. 24C is a partial cross-sectional view showing the attached barrel overlap portion after attachment of the retort cup related to the embodiment.

As shown in FIGS. 24A to 24C, an extending resin portion (end edge extending portion) 404*a* is formed at one end edge 411 of the barrel member blank 410 by causing the thermoplastic resin layer 440 at least on the inner surface side to extend outwardly from the lateral end edge of the paper layer 401. FIGS. 24A to 24C show an example in which the extending resin portion is also provided on the thermoplastic resin layer 441 on the outer surface side similarly to the inner surface side.

Moreover, in the retort cup related to the present embodiment, a cutout 431 is provided in the portion of the upper paper layer 401 of one end edge 411. As a result, the portion of the cutout 431 of the extending resin portion 404*a* is formed as a layer with no paper layer 401 and composed of only resin including thermoplastic resin.

As shown in FIGS. 24A to 24C, the extending resin portion 404*a* may have a configuration which the extending resin portion has a fold-back resin portion 404*b* as well as extending outwardly from the end of the paper layer 401. The fold-back resin portion 404*b* is close to the paper layer 401 and formed by folding back the extending resin portion 404*a* to the outer surface side of the paper layer 401.

By adopting the configuration in which the fold-back resin portion 404*b* is folded back to the outer surface side of the paper layer 401 in this way, not only penetration of the contents can be prevented from the base ends, but also the amount of resin in the attached portion 415 can be secured. As a result, the sealing performance of the attached portion of both lateral ends of the barrel member becomes excellent.

Moreover, the portion formed in the cutout 431 of the extending resin portion 404*a* is a fold-back resin portion 404*b* with no paper layer 401 and made up of a layer of only resin. For this reason, when the upper flange portion 416 of the attached barrel overlap portion 415, a sufficient amount of resin to join the flange portion can be secured, and smoothing of the top surface of the flange can be performed without a defect. As a result, the sealing performance between the flange portion 416 and a lid member (not shown) becomes excellent.

The width of the extending resin portion 404*a* is preferably a width equal to or more than the thickness of the paper layer 401. More preferably, the width of the extending resin portion 404*a* is preferably a width equal to or more than the thickness the barrel member blank 410.

Figure 25A:
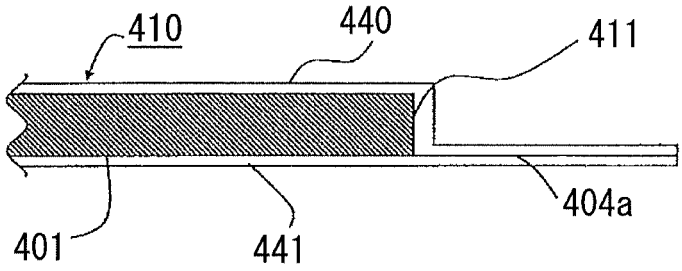
FIG. 25A is a partial cross-sectional view showing a blank which becomes the inside of the attached barrel overlap portion of the retort cup related to the embodiment.
Figure 25B:
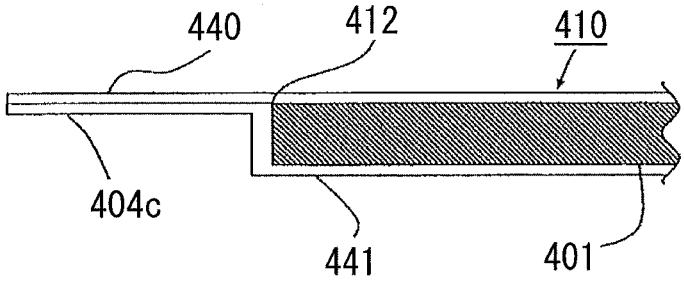
FIG. 25B is a partial cross-sectional view showing the blank which becomes the outside of the attached barrel overlap portion of the retort cup related to the embodiment.
Figure 25C:
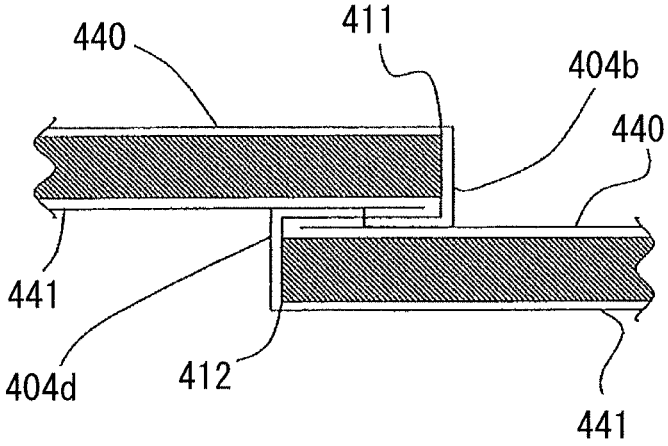
FIG. 25C is a partial cross-sectional view showing the attached barrel overlap portion after attachment of the retort cup related to the embodiment.

Here, although the case where the extending resin portion 404*a* which extends outwardly from the lateral end edge of the paper layer 401 is provided at one lateral end edge of the barrel member blank 410 has been described, a configuration in which the extending resin portions 404*a* are provided at both end edges as shown in FIGS. 25A to 25C may be adopted. Through such a configuration, penetration of moisture from the outer paper layer end surface of the attached portion 415 or the like can be prevented, and a more effective barrier property can be given.

Since the retort cup related to the present embodiment has such a structure, the end surface of the paper layer located inside the attached barrel overlap portion 415 is protected by the extending resin portion 404*a* or the fold-back resin portion 404*b*. As a result, the contents filled into the container do not penetrate from the paper layer end surfaces.

Here, as shown in FIGS. 24A to 24C, the thermoplastic resin layer 440 may have a configuration in which the thermoplastic resin layer is provided on the outer surface side of the paper layer as well as on the inner surface side of the paper layer 401. By providing the thermoplastic resin layers 440 and 441 on both surfaces of the paper layer in this way, the extending resin portion 404*a* which is formed on the base end surface is formed, with the thermoplastic resin layers 440 and 441 on both the surfaces being integrated at the outer edges.

Additionally, the extending resin portion 404*a* may have a configuration in which, for example, separate members, such as thermoplastic resin tapes, are provided at the ends of the paper layer, and are integrated at the outer edges similarly to the above description, instead of a method of forming the extending resin portion by the thermoplastic resin layer.

Additionally, the extending resin portion 404*a* may have a configuration in which a thermoplastic resin layer provided on the paper layer is used on one side, a thermoplastic resin tape is used on the other side, and these are integrated at the outer edges similarly to the above description.

Moreover, as for the extending resin portion 404*a*, a cutout portion obtained by cutting out the paper layer may be provided at an upper corner of the barrel member blank. In this case, the sealing performance of the flange portion can be improved.

Moreover, in the configuration in which the extending resin portion 404*a* extends outwardly from the end edge of the paper layer as mentioned above, protection of both end edges of the barrel member can be performed.

Figure 27A:
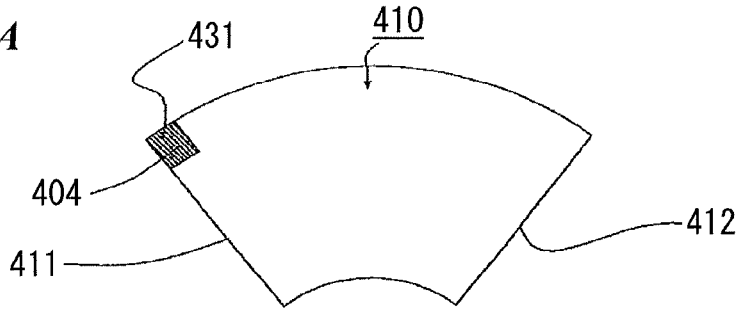
FIG. 27A is a plan view showing the shape of an extending resin layer of the barrel member blank used for the manufacture of the retort cup related to the embodiment.
Figure 27B:
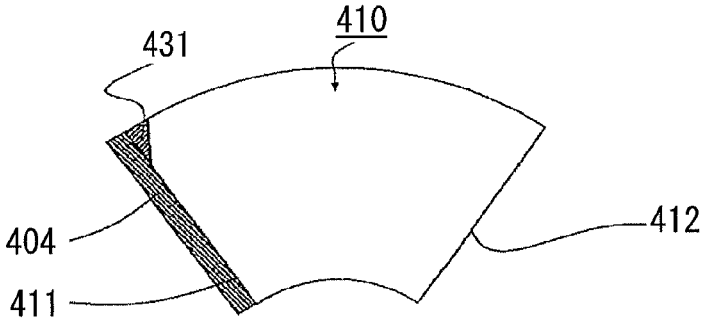
FIG. 27B is a plan view showing the shape of the extending resin layer of the barrel member blank used for the manufacture of the retort cup related to the embodiment.
Figure 27C:
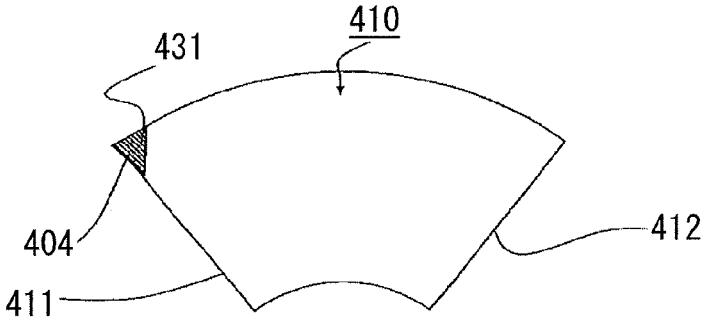
FIG. 27C is a plan view showing the shape of the extending resin layer of the barrel member blank used for the manufacture of the retort cup related to the embodiment.

FIGS. 27A to 27C are plan views showing the shape of an extending resin layer of the barrel member blank used for the manufacture of the retort cup related to the embodiment.

Figure 22A:
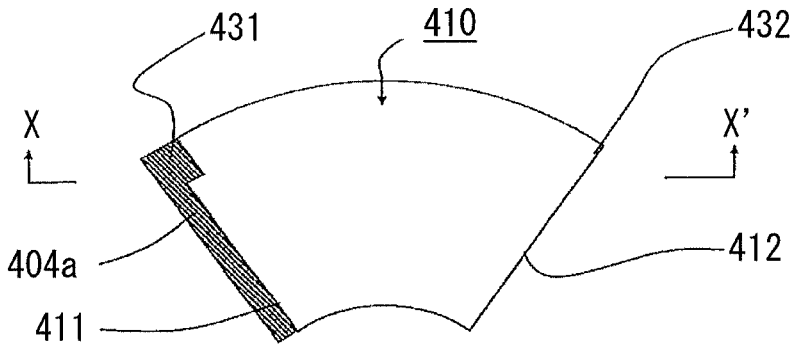
FIG. 22A is a plan view showing a second punching process of punching the barrel member blank having a resin portion used for the manufacture of the retort cup related to the embodiment in a predetermined shape.

FIG. 27A, similarly to the blank shown in FIG. 22A, shows a case where the cutout portion 431 of the paper layer of the upper corner is rectangular, and the extending resin portion 404 is formed only in the rectangular cutout portions.

FIG. 27B, similarly to the blank shown in FIG. 22A, shows a case where there is the extending resin portion 404 from both end edges 411 and 412 of the barrel member, and the cutout portion 431 of the paper layer of the upper corner is triangular.

FIG. 27C shows a case where the cutout portion 431 of the paper layer of the upper corner of blank is triangular, and there is no extending resin portion 404 from both end edges 411 and 412 of the barrel member.

The shape of the cutout portions 431 of these paper layers, and the presence/absence of the extending resin portion 404 from both end edges 411 and 412 of the barrel member are appropriately selected depending on the degree of a property and the degree of the sealing performance which are required.

Particularly, in order to prevent infiltration from the ends caused by contents, it is preferable to have the fold-back resin portion 404*b* as shown in FIGS. 24A to 24C rather than the configuration in which the resin portion simply extends outwardly. The fold-back resin portion 404*b* is formed by folding back the extending resin portion 404*a* which has extended, to the outer surface side of the paper layer.

Moreover, in order to strengthen the barrier property against moisture or the like from the outside, as shown in FIGS. 25A to 25C, it is preferable to have the fold-back resin portion 404*d*. The fold-back resin portion 404*d* is formed by folding back the extending resin portion (end edge extending portion) 404*c* which has extended, to the inner surface side of the paper layer.

Through the configuration in which the resin portion has the fold-back resin portion which is folded back to the inner surface side or outer surface side of the paper layer, the level difference of the attached barrel overlap portion is filled by the fold-back resin portion. As a result, a configuration with no level difference may be provided. Moreover, a configuration in which the end surface of the fold-back resin portion is not exposed to the inside or outside of the retort cup can be provided.

As shown in FIG. 24C, the lateral end edge provided with the extending resin portion 404*a* of the barrel member blank 410 is overlapped with the barrel member 418 so as to become the inside, and the attached barrel overlap portion 415 is formed by heating and pressing. As shown in FIG. 19, the upper portion of one end edge of the barrel member blank 410 is provided with the cutout portion 431 of the paper layer, and a thermoplastic resin coating extends on that portion.

Here, the portion of the cutout portion 431 of the paper layer of the lateral end provided with the extending resin portion 404*a* is present, with a thermoplastic resin coating being overlapped. For this reason, a sufficient amount of thermoplastic resin to fill and seal the gap of the joining portion of the flange portion can be supplied.

Additionally, even in a case where the top surface of the flange portion 416 is made flat, the top surface of the joining portion of the flange portion is continuously formed of resin above the attached barrel overlap portion 415. This can eliminate the level difference caused at the position of the attached portion.

The retort cup related to the present embodiment can have a configuration in which the thermoplastic resin layer 440 or 441 has a barrier layer.

Through the configuration in which the thermoplastic resin layer 440 or 441 includes a barrier layer, the end surfaces of the paper layer 401 are protected by the barrier layer. As a result, the cup-like paper container having an excellent barrier property can be formed.

As the above barrier layer, layered materials having an excellent gas barrier property, such as an aluminum foil, an aluminum vapor-deposited plastic film, an inorganic compound vapor-deposited plastic film, an ethylene polyvinyl alcohol copolymer film, a polyethylene terephthalate film, and a polyamide film, can be used.

Additionally, as shown in FIGS. 24A to 24C, a configuration is provided in which the end surfaces of the barrier layer are not exposed to the inside of the container by having the fold-back resin portion 404*b* in which the resin portion is folded back. As a result, since contents do not come into contact with the barrier layer, a retort cup in which preservation of contents is not affected is obtained.

Additionally, a configuration in which the thermoplastic resin layer 441, such as polyethylene, is provided on the outer surface of the paper layer 401, and the thermoplastic resin layers 440 and 441 are provided on both surfaces of the paper layer can also be adopted.

Through the configuration in which the thermoplastic resin layers are provided on both surface of the outer surface and inner surface of the paper layer 401, the inner surfaces of the tips of the thermoplastic resin layers 440 and 441 on both surfaces can be integrated, to form the extending resin portion 404*a*.

Particularly, the fold-back resin portion 404*b* formed of the thermoplastic resin layers 440 and 441 on both surfaces has a configuration in which the extending resin portion 404*a* is folded back to the outer surface side of the paper layer. As a result, since a constant amount of resin can be provided, the level difference of the attached barrel overlap portion 415 can be eliminated when the barrel portion is formed.

Additionally, in a configuration in which the thermoplastic resin layer 440 includes a barrier layer made of a material different from thermoplastic resin, the end surfaces of the barrier layer are not exposed to the inside of the container because a fold-back configuration is provided. Therefore, since contents do not come into contact with the barrier layer, preservation of contents is not affected.

Moreover, as shown in FIGS. 25A to 25C, in a configuration in which the inner paper layer end edge 411 and the outer paper layer end edge 412 of the attached barrel overlap portion 415 are covered with the fold-back resin portions 404*b* and 404*d*, a retort cup having excellent water resistance can be obtained because the rigidity of the paper layer does not become weak even if liquids, such as water from the outside, adhere.

Figure 26A:
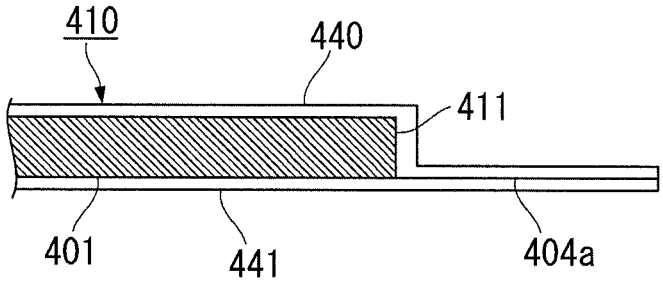
FIG. 26A is a partial cross-sectional view showing a blank which becomes the inside of the attached barrel overlap portion of the retort cup related to the embodiment.
Figure 26B:
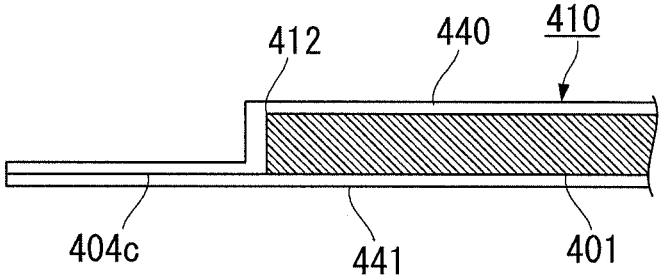
FIG. 26B is a partial cross-sectional view showing the blank which becomes the outside of the attached barrel overlap portion of the retort cup related to the embodiment.
Figure 26C:
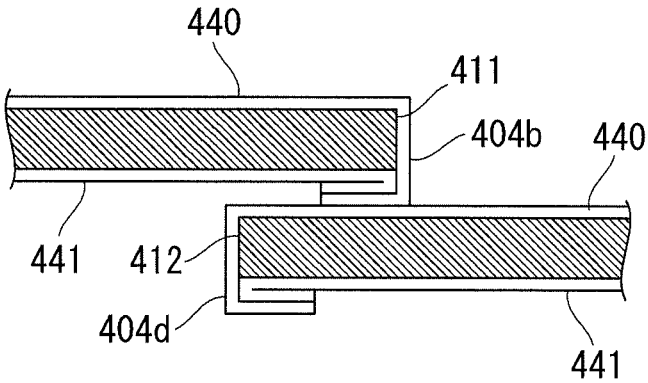
FIG. 26C is a partial cross-sectional view showing the attached barrel overlap portion after attachment of the retort cup related to the embodiment.

Additionally, as shown in FIGS. 26A to 26C, the fold-back resin portions 404*b* and 404*d* may be provided, and the fold-back resin portions 404*b* and 404*d* may be formed by folding back the extending resin portions (end edge extending portions) 404*a* and 404*c* which have extended, to the outer surface side of the paper layer, respectively.

Since both the resin portions 404*b* and 404*d* provided at both ends of the barrel member blank 410 are folded back to the outer surface side of the paper layer, these two fold-back resin portions can be easily folded back and formed simultaneously. That is, since the extending resin portions at both ends are folded back in the same direction to form the fold-back resin portions, it is not necessary to change the fold-back direction in this folding-back process. For this reason, the process of forming the fold-back resin portions at both ends is shortened. As a result, the manufacturing process of the retort cup can be shortened, and productivity can be improved.

Next, a manufacturing method of the barrel member blank in the manufacturing method of the retort cup related to the present embodiment will be described.

First, a plurality of sector-shaped barrel member blanks 410 is assigned side by side and printed on a roll-like paper layer 401. In one end edge 411 of the barrel member blank, an outward portion including the end edge is bored as a long window 413.

Figure 20A:
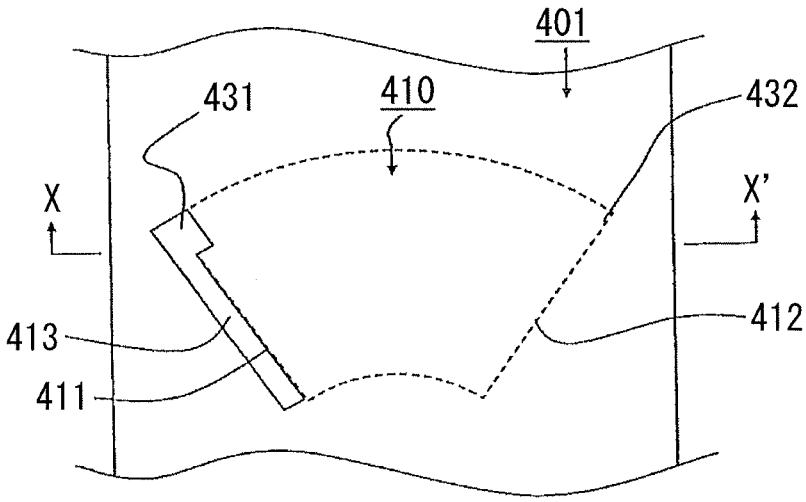
FIG. 20A is a plan view showing a first punching process of providing a long window of a barrel member blank used for the manufacture of the retort cup related to the embodiment.
Figure 20B:
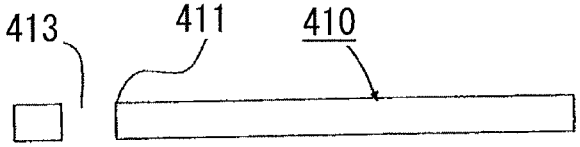
FIG. 20B is a cross-sectional view taken along the line X-X' of FIG. 20A showing the first punching process of providing the long window of the barrel member blank used for the manufacture of the retort cup related to the embodiment.

The long window has a shape including the cutout portion 431 in the upper portion and a rectangular portion outside of the end edge 411 (refer to FIGS. 20A and 20B) (first punching process).

Figure 21A:
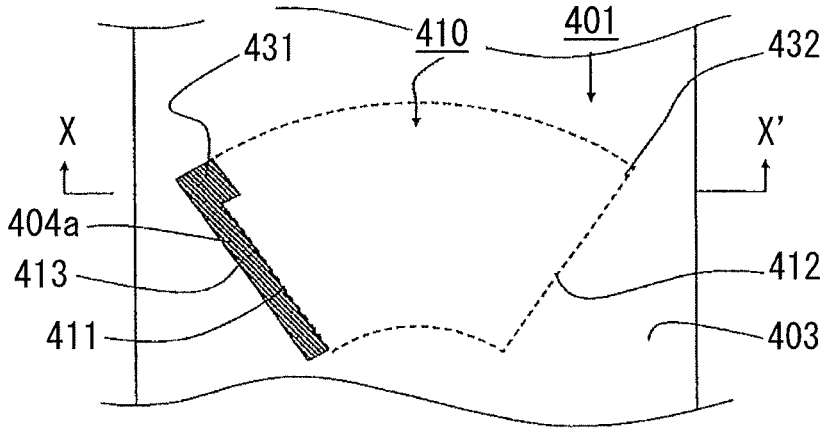
FIG. 21A is a plan view showing a thermoplastic resin attachment process of the barrel member blank used for the manufacture of the retort cup related to the embodiment.
Figure 21B:
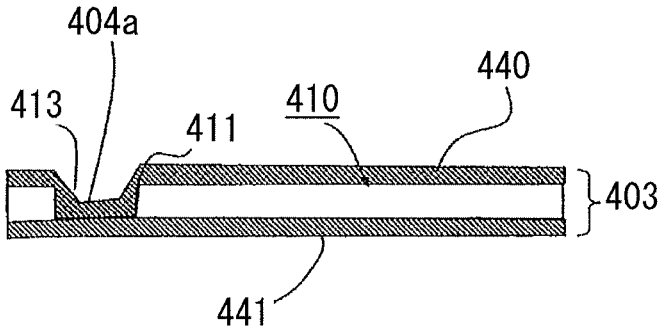
FIG. 21B is a cross-sectional view taken along the line X-X' of FIG. 21A showing a thermoplastic resin attachment process of the barrel member blank used for the manufacture of the retort cup related to the embodiment.

A laminated sheet 403 is formed by laminating the thermoplastic resin layers 440 and 441, such as polyethylene resin, on the inner surface and outer surface of the paper layer 401 in which the long window 413 is bored by printing the barrel member blank 410, using a melting resin extrusion process. At this time, the extending resin portion 404*a* is formed on a long window portion of the paper layer 401 by the two thermoplastic resin layers (refer to FIGS. 21A and 21B) (thermoplastic resin attachment process).

Figure 22B:
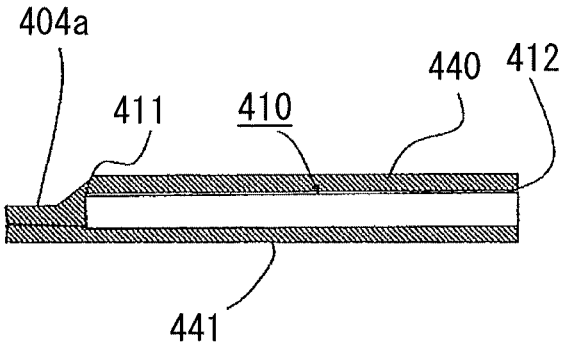
FIG. 22B is a cross-sectional view taken along the line X-X' of FIG. 22A showing the second punching process of punching the barrel member blank having a resin portion used for the manufacture of the retort cup related to the embodiment in a predetermined shape.

Portions which are unnecessary for the barrel member blank 410 on the side where the long window portion including the extending resin portion 404*a* provided so as to extend outwardly from the paper layer 401 is formed are continuously cut from the laminated sheet 403. The plurality of sector-shaped barrel member blanks 410 printed from the laminated sheet 403 from which the unnecessary portions on one side are cut off is punched, and barrel member blanks 410 in which the extending resin portion 404*a* is formed are prepared one by one (FIGS. 22A and 22B) (second punching process).

Figure 23A:
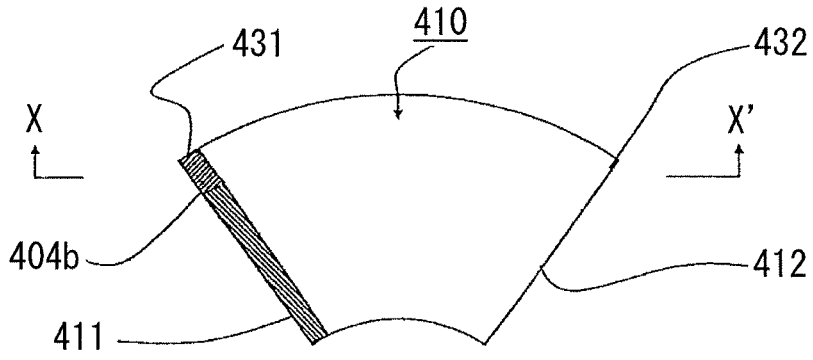
FIG. 23A is a plan view showing the process of bending and temporarily bonding the resin portion used for the manufacture of the retort cup related to the embodiment to the outer surface side of a paper layer.
Figure 23B:
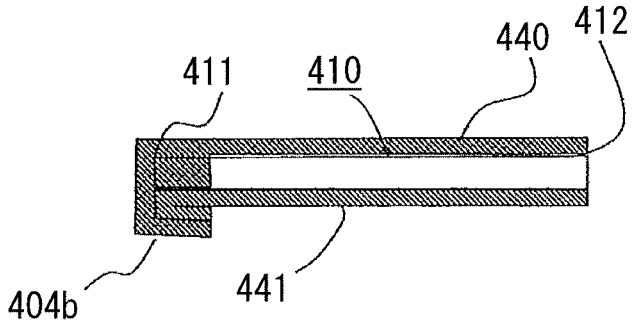
FIG. 23B is a cross-sectional view taken along the line X-X' of FIG. 23A showing the process of bending and temporarily bonding the resin portion used for the manufacture of the retort cup related to the embodiment to the outer surface side of the paper layer.

Next, a barrel member blank 410 in which the fold-back resin portion 404*b* is formed is prepared by folding back and temporarily bonding the extending resin portion 404*a* (refer to FIGS. 23A and 23B) (resin portion bending process). The extending resin portion 404*a* is provided so as to extend outwardly from one barrel member blank 410.

The barrel member blank 410 in which the resin portion 404*b* is formed at one lateral end edge can be prepared through such respective processes. The resin portion 404*b* is formed by bending the extending resin portion 404*a* of the long window portion 413 which extends with a predetermined width outwardly from the end edge of the paper layer 401.

At this time, the extending resin portion of the region of the cutout portion 431 of the paper layer is folded back with this resin portion being overlapped. The other extending resin portion is folded back inwardly from the end surface of the paper layer.

An example of a forming method of forming a retort cup using the barrel member blank 410 prepared by such a method has been described with reference to FIG. 19 as described above. Hence, the description thereof is omitted herein.

The retort cup related to the present embodiment uses for the barrel member 418 the barrel member blank 410 in which a thermoplastic resin coating is provided on the cutout portion 431 of the upper portion of the end edge. For this reason, when the upper peripheral edge of the barrel member 418 is wound outwardly one round or more to form the flange portion 416, even at the attached portion 415, a sufficient amount of thermoplastic resin required for bonding is present. As a result, the level difference of the flange portion can be eliminated with no gap.

Additionally, since the level difference caused on the top surface of the flange portion can be eliminated for the same reason even if the top surface of the flange portion 415 is flat, leakage or the like of contents by the gap can be effectively prevented even when the flange portion is sealed by a lid member.

Figure 28:
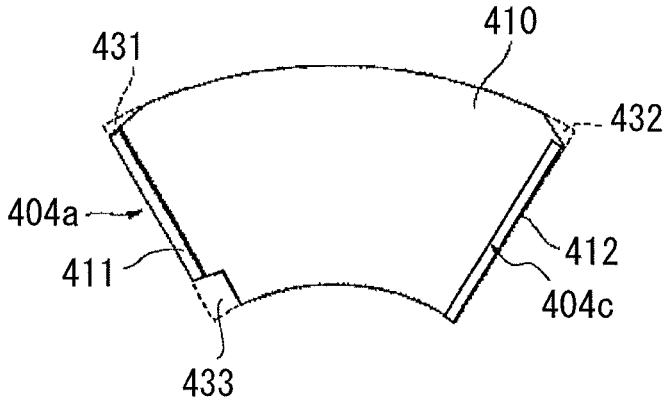
FIG. 28 is a plan view showing the shape of the barrel member blank used for the manufacture of the retort cup related to the embodiment.

FIG. 28 is a plan view showing the shape of the barrel member blank used for the manufacture of the retort cup related to the embodiment. Cutout portions 431 and 432 of the paper layer are provided in upper corners of the barrel member blank 410. Additionally, a cutout portion of the paper layer 433 is provided in a lower portion of the barrel member end edge 411 of the barrel member blank.

As the cutout portion 433 is provided, when the barrel member 418 is wound inwardly to form the annular leg 422, the paper base is brought into a wound state with the same overlap as portions other than the attached portion. This can eliminate the level difference caused at the position of the attached portion 415.

EXAMPLES

Example 1

A long window was formed in a sheet made of a paper base (basis weight of 260 g/m$^2$).

Next, a low-density polyethylene layer (30 μm) was provided on the front surface of the paper base of the sheet. A low-density polyethylene layer (30 μm), an aluminum foil (9 μm), a polyethylene terephthalate film (12 μm), and a low-density polyethylene layer (70 μm) were provided on the rear surface of the paper base. Thereafter, the inner surface of the low-density polyethylene layer was joined and integrated at the position of the long window.

Then, the barrel portion blank 10 was formed by performing punching in the shape of a sector (225 mm in length of the upper side, and 162 mm in length of the lower side). This sector shape has a triangular cutout portion with a width of 9 mm and a height of 5 mm at the upper portion of one lateral end edge of the paper base. This sector shape has a triangular cutout portion with a width of 8 mm and a height of 6 mm at the upper portion of the other lateral end.

In addition, the width of resin portions provided at both lateral end edges is 5 mm. The barrel portion blank 10 having the end edge extending piece resin portions was formed in this way.

The lateral end edges of the blank having the end edge extending piece resin portions are integrated by being overlapped with and joined to each other such that the length L of overlap becomes 5 mm. As a result, a barrel portion provided with the attached barrel overlap portion was formed.

Next, the lower inner surface of the barrel portion was joined to the outer surface of a peripheral edge portion 21 of a bottom member. The bottom member 20 has a circular shape and has a peripheral edge portion 21 which is erected downwardly.

Then, the outer surface of the peripheral edge portion 21 of the bottom member 20 is joined to the lower inner surface of the barrel member 18, using a cup forming machine. Moreover, the barrel member 18 was bent inwardly while being curled so as to cover the peripheral edge portion 21, and was brought into a state where the lower end edge thereof is located between the upper fold-back portion 24 of the barrel member 18 and the downwardly bent portion 21 of the peripheral edge portion of the bottom portion forming blank. In this state, the barrel member was joined to the inner surface of the peripheral edge portion 21 of the bottom member 20, thereby forming an annular leg 22 with a diameter of 52 mm.

Additionally, a top opening portion of the barrel member 18 was wound one round or more by a top curling unit, thereby forming a retort cup in which the diameter of the opening is 69 mm was formed. This retort cup has a flange portion 16 with a width of 3 mm in which a bottom half has single winding and a top half has double winding.

As a result, the retort cup was formed with no level difference at the attached barrel overlap portion 15 and the portion of the top surface of the flange portion 16 located at the attached barrel overlap portion. Additionally, the strength and water resistance of the attached portion of the barrel portion and the bottom portion are also sufficient, and even if being soaked and cooled with water, abnormalities, such as swelling of the paper base, were not seen.

Example 2

The flange portion 16 of the retort cup of Example 1 was pressed and pressure-bonded from above and below using an ultrasonic seal apparatus, and the top surface of the flange was made flat.

As a result, the retort cup was formed with no level difference at the portion of the top surface of the flange portion 16 located at the attached barrel overlap portion 15, irrespective of whether the top surface of the flange portion 16 was made flat. Additionally, the strength and water resistance of the attached portion of the barrel portion and the bottom portion are sufficient, and even if being soaked and cooled with water, abnormalities, such as swelling of the paper base, were not seen.

Example 3

A long window was formed in a sheet composed of a paper base (basis weight of 260 g/m$^2$), a low-density polyethylene layer (30 μm), an aluminum foil (9 μm), and a polyethylene terephthalate film (12 μm) from the front side.

Next, a low-density polyethylene layer (30 μm) was provided on the front surface of the paper base of the laminated sheet, while a polyethylene layer (70 μm) was provided on the surface of the polyethylene terephthalate film. Thereafter, the inner surface of the low-density polyethylene layer was joined and integrated at the position of the long window.

Then, the barrel portion blank 10 was formed by performing punching in the shape of a sector (225 mm in length of the upper side, and 162 mm in length of the lower side). While this sector shape has a triangular cutout portion with a width of 9 mm and a height of 5 mm at the upper portion of one lateral end edge of the paper base, the sector shape has a triangular cutout portion with a width of 8 mm and a height of 6 mm at the upper portion of the other lateral end. In addition, resin portions which become end edge extending pieces provided at both lateral end edges were provided with a width of 5 mm, and were pressure-bonded without being folded back.

The lateral end edges having the end edge extending pieces of the blank were overlapped with each other by 5 mm, and were integrated by pressure-bonding and joining the end edge extending pieces to the front surface of the base, whereby the attached barrel overlap portion 15 was provided to form a barrel portion.

Next, the lower inner surface of the barrel portion was joined to the outer surface of a peripheral edge portion 21 of a bottom member 20. The bottom member 20 has a circular shape and has a peripheral edge portion 21 which is erected downwardly.

Then, the outer surface of the peripheral edge portion 21 of the bottom member 20 is joined to the lower inner surface of the barrel member 18, using a cup forming machine. Moreover, the barrel member 18 was bent inwardly while being curled so as to cover the peripheral edge portion 21, and was brought into a state where the lower end edge thereof is located between the upper fold-back portion 24 of the barrel member 18 and the downwardly bent portion 21 of the peripheral edge portion of the bottom portion forming blank. In this state, the barrel member was joined to the inner surface of the peripheral edge portion 21 of the bottom member 20, thereby forming an annular leg 22 with a diameter of 52 mm.

Additionally, a retort cup in which the diameter of the opening is 69 mm was formed by a top curling unit. This retort cup has a flange portion 16 with a width of 3 mm in which the top opening portion is wound one round or more, a bottom half has single winding, and a top half has double winding.

As a result, the retort cup was formed with no level difference at the attached barrel overlap portion 15 and the portion of the top surface of the flange portion 16 located at the attached barrel overlap portion. Additionally, the strength and water resistance of the attached portion of the barrel portion and the bottom portion are sufficient, and even if being soaked and cooled with water, abnormalities, such as swelling of the paper base, were not seen.

Example 4

A long window was formed in a sheet composed of a low-density polyethylene layer (30 μm and a paper base (basis weight of 260 g/m$^2$) from the front side.

Next, a low-density polyethylene layer (30 μm), an aluminum foil (9 μm), a polyethylene terephthalate film (12 μm), and a low-density polyethylene layer (15 μm) were provided on the rear surface of the paper base, and were provided so as to cover a long window portion of the front surface of the sheet paper base.

Then, the barrel portion blank 10 was formed by performing punching in the shape of a sector (225 mm in length of the upper side, and 162 mm in length of the lower side). While this sector shape has a triangular cutout portion with a width of 9 mm and a height of 5 mm at the upper portion of the lateral end edge of one paper base, the sector shape has a triangular cutout portion with a width of 8 mm and a height of 6 mm at the upper portion of the other lateral end. In addition, the width of resin portions which becomes end edge extending pieces provided at both lateral end edges is 5 mm.

The lateral end edges having the end edge extending pieces of the blank were overlapped with each other by 5 mm, and were integrated by pressure-bonding and joining the end edge extending pieces to the front surface of the base, whereby the attached barrel overlap portion was provided to form a barrel portion.

Next, the lower inner surface of the barrel portion was joined to the outer surface of a peripheral edge portion 21 of a bottom member 20. The bottom member 20 has a circular shape and has a peripheral edge portion 21 which is erected downwardly.

Then, the outer surface of the peripheral edge portion 21 of the bottom member 20 is joined to the lower inner surface of the barrel member 18, using a cup forming machine. Moreover, the barrel member 18 was bent inwardly while being curled so as to cover the peripheral edge portion 21, and was brought into a state where the lower end edge thereof is located between the upper fold-back portion 24 of the barrel member 18 and the downwardly bent portion 21 of the peripheral edge portion of the bottom portion forming blank. In this state, the barrel member was joined to the inner surface of the peripheral edge portion 21 of the bottom member 20, thereby forming an annular leg 22 with a diameter of 52 mm.

Additionally, a retort cup in which the diameter of the opening is 69 mm was formed by a top curling unit. This retort cup has a flange portion 16 with a width of 3 mm in which the top opening portion is wound one round or more, a bottom half has single winding, and a top half has double winding.

As a result, the retort cup was formed with no level difference at the portion of the top surface of the flange portion 16 located at the attached barrel overlap portion 15. Additionally, the strength of the attached portion of the barrel portion and the bottom portion is sufficient, and even if being soaked and cooled with water, abnormalities, such as swelling of the paper base, were not seen.

Example 5

A long window was formed in a sheet made of a paper base (basis weight of 260 g/m$^2$) from the front side.

Next, a low-density polyethylene layer (30 μm) was provided on the front surface of the paper base of the sheet, and a low-density polyethylene layer (30 μm), an aluminum foil (9 μm), a polyethylene terephthalate film (12 μm), and a low-density polyethylene layer (70 μm) were provided on the rear surface of the paper base. Thereafter, the inner surface of the low-density polyethylene layer was joined and integrated at the position of the long window.

Then, the barrel portion blank was formed by performing punching in the shape of a sector (225 mm in length of the upper side, and 162 mm in length of the lower side). This sector shape has a triangular cutout portion with a width of 9 mm and a height of 5 mm at the upper portion of one lateral end edge of the paper base. This sector shape has a triangular cutout portion with a width of 8 mm and a height of 6 mm at the upper portion of the other lateral end.

In addition, the width of resin portions provided at both lateral end edges is 5 mm. The barrel portion blank having fold-back resin portions which extend 2.5 mm was formed in this way.

The lateral end edges of the blank having the fold-back resin portions were overlapped, joined, and integrated, whereby the attached barrel overlap portion was provided to form a barrel portion.

Next, the lower inner surface of the barrel portion was joined to the outer surface of a peripheral edge portion 221 of a bottom member 220. The bottom member 220 has a circular shape and has a peripheral edge portion 221 which is erected downwardly.

Then, the outer surface of the peripheral edge portion 221 of the bottom member 220 is joined to the lower inner surface of the barrel member 218, using a cup forming machine. Moreover, the lower end edge of the barrel member 218 is bent downwardly so as to cover the peripheral edge portion 221 and is joined to the inner surface of the peripheral edge portion 221 of the bottom member, whereby an annular leg 222 with a diameter of 52 mm is formed.

Additionally, a top opening portion was wound one round or more by a top curling unit, thereby forming a cup-like paper container in which the diameter of the opening is 69 mm was formed. This cup-like container has a flange portion 216 with a width of 3 mm in which a bottom half has single winding and a top half has double winding.

As a result, the cup-like container was formed with no level difference at the attached barrel overlap portion and the portion of the top surface of the flange portion located at the attached barrel overlap portion.

Example 6

The flange portion 216 of Example 5 was pressed and pressure-bonded from above and below using an ultrasonic seal apparatus, and the top surface of the flange portion 216 was made flat.

As a result, the cup-like container was formed with no level difference at the portion of the top surface of the flange portion 216 located at the attached barrel overlap portion, irrespective of whether the top surface of the flange portion 216 was made flat.

Example 7

A long window was formed in a sheet composed of a paper base (basis weight of 260 g/m$^2$), a low-density polyethylene layer

Figure 9A:
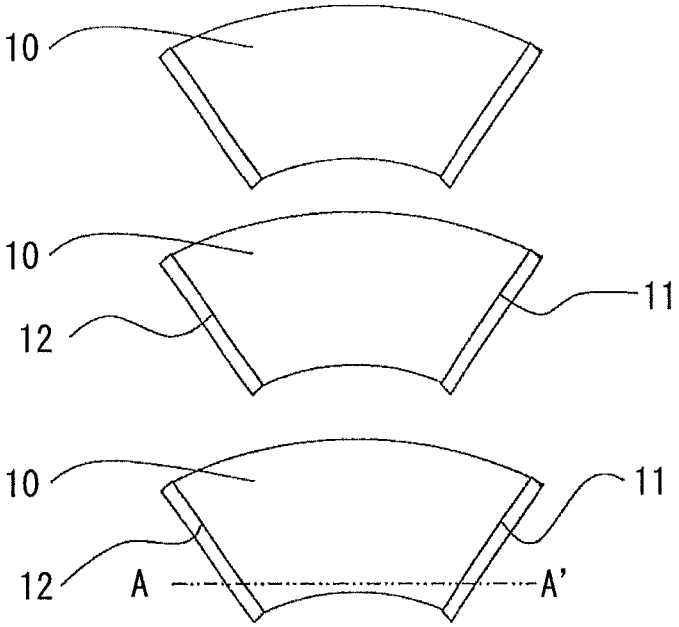
FIG. 9A is a plan view showing the process of punching the barrel member blank used for the manufacture of the retort cup related to the embodiment in a predetermined shape, and pressure-bonding an outwardly extending resin portion.
Figure 9B:
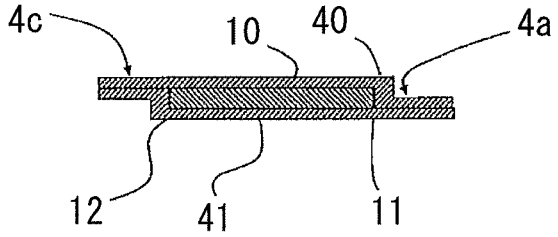
FIG. 9B is a cross-sectional view taken along the line A-A' of FIG. 9A showing the process of punching the barrel member blank used for the manufacture of the retort cup related to the embodiment in a predetermined shape, and pressure-bonding the outwardly extending resin portion.

[FIG.9](30 μm), an aluminum foil (9 μm), and a polyethylene terephthalate film (12 μm) from the front side.

Next, a low-density polyethylene layer (30 μm) and a polyethylene layer (70 μm) were provided on the front surface of the paper base of the laminated sheet. Thereafter, the inner surface of the low-density polyethylene layer was joined and integrated at the position of the long window.

Then, the barrel portion blank was formed by performing punching in the shape of a sector (225 mm in length of the upper side, and 162 mm in length of the lower side). This sector shape has a triangular cutout portion with a width of 9 mm and a height of 5 mm at the upper portion of one lateral end edge of the paper base. This sector shape has a triangular cutout portion with a width of 8 mm and a height of 6 mm at the upper portion of the other lateral end.

In addition, the width of a resin portion provided at one lateral end edge is 5 mm. The width of a fold-back resin portion is 2.5 mm. A resin portion provided at the other lateral end edge has a width of 5 mm and was pressure-bonded without being folded back.

With the lateral end edge having the fold-back resin of the blank being placed inside, an outwardly extending resin portion was pressure-bonded, and joined and integrated with the front surface of the inner base, whereby the attached barrel overlap portion with a width of 5 mm was provided to form a barrel portion. This outwardly extending resin portion is provided at the outer lateral end edge by overlapping the lateral end edges.

Next, the lower inner surface of the barrel portion was joined to the outer surface of a peripheral edge portion 221 of a bottom member 220. The bottom member 220 has a circular shape and has a peripheral edge portion 221 which is erected downwardly.

Then, the outer surface of the peripheral edge portion 221 of the bottom member 220 is joined to the lower inner surface of the barrel member 218, using a cup forming machine. Moreover, the lower end edge of the barrel member 218 is bent downwardly so as to cover the peripheral edge portion 221 and is joined to the inner surface of the peripheral edge portion 221 of the bottom member 220, whereby an annular leg 222 with a diameter of 52 mm is formed.

Additionally, a top opening portion was wound one round or more by a top curling unit, thereby forming a cup-like paper container in which the diameter of the opening is 69 mm was formed. This cup-like container has a flange portion 216 with a width of 3 mm in which a bottom half has single winding and a top half has double winding.

As a result, the cup-like container was formed with no level difference at the attached barrel overlap portion 215 and the portion of the top surface of the flange portion 216 located at the attached barrel overlap portion.

Example 8

The flange portion 216 of Example 7 was pressed and pressure-bonded from above and below using an ultrasonic seal apparatus, and the top surface of the flange portion 216 was made flat.

As a result, the cup-like container was formed with no level difference at the portion located at the attached barrel overlap portion, irrespective of whether the top surface of the flange portion 216 was made flat.

Example 9

A long window was formed in a sheet composed of a low-density polyethylene layer (30 μm) and a paper base (basis weight of 260 g/m$^2$) from the front side.

Next, a low-density polyethylene layer (30 μm), an aluminum foil (9 μm), a polyethylene terephthalate film (12 μm), and a low-density polyethylene layer (15 μm) were provided on the rear surface of the paper base so as to cover a long window portion of the front surface of the sheet paper base.

Next, the barrel portion blank was formed by performing punching in the shape of a sector (225 mm in length of the upper side, and 162 mm in length of the lower side). This sector shape has a triangular cutout portion with a width of 9 mm and a height of 5 mm at the upper portion of the lateral end edge of one paper base. This sector shape has a triangular cutout portion with a width of 8 mm and a height of 6 mm at the upper portion of the other lateral end.

In addition, the width of resin portions provided at both lateral end edges is 5 mm. The width of fold-back resin portions is 2.5 mm.

The lateral end edges having resin layers of the blank were overlapped, joined, and integrated, whereby the attached barrel overlap portion was provided to form a barrel portion.

Next, the lower inner surface of the barrel portion was joined to the outer surface of a peripheral edge portion 221 of a bottom member 220. The bottom member 220 has a circular shape and has a peripheral edge portion 221 which is erected downwardly.

Then, the outer surface of the peripheral edge portion 221 of the bottom member 220 is joined to the lower inner surface of the barrel member 218, using a cup forming machine. Moreover, the lower end edge of the barrel member 218 is bent downwardly so as to cover the peripheral edge portion 221 and is joined to the inner surface of the peripheral edge portion 221 of the bottom member, whereby an annular leg 222 with a diameter of 52 mm is formed.

Additionally, a top opening portion was wound one round or more by a top curling unit, thereby forming a cup-like paper container in which the diameter of the opening is 69 mm was formed. This cup-like container has a flange portion 216 with a width of 3 mm in which a bottom half has single winding and a top half has double winding.

As a result, the cup-like container was formed with no level difference at the portion of the top surface of the flange portion 216 located at the attached barrel overlap portion 215.

Example 10

The flange portion 215 of Example 9 was pressed and pressure-bonded from above and below using an ultrasonic seal apparatus, and the top surface of the flange portion 216 was made flat.

As a result, the cup-like container was formed with no level difference at the portion located at the attached barrel overlap portion 215, irrespective of whether the top surface of the flange portion 216 was made flat.

INDUSTRIAL APPLICABILITY

According to the invention, it is possible to provide a retort cup which has a neat finish appearance as a retort cup, and has excellent water resistance, sealing performance, and barrier property.

DESCRIPTION OF THE REFERENCE SYMBOLS

1: PAPER BASE (PAPER LAYER)
2: BASE SHEET
40: THERMOPLASTIC RESIN LAYER
41: THERMOPLASTIC RESIN LAYER
42: RESIN PORTION END GAP
4: RESIN PORTION
4*a*: END EDGE EXTENDING PORTION (OUTWARDLY EXTENDING RESIN PORTION)
4*b*: END EDGE EXTENDING PORTION (FOLD-BACK RESIN PORTION)
4*c*: END EDGE EXTENDING PORTION (OUTWARDLY EXTENDING RESIN PORTION)
4*d*: END EDGE EXTENDING PORTION (FOLD-BACK RESIN PORTION)
10: BARREL MEMBER BLANK (BARREL PORTION FORMING BLANK)
11: LATERAL END EDGE (END EDGE) HAVING RESIN PORTION
12: LATERAL END EDGE (END EDGE) HAVING RESIN PORTION
13: LONG WINDOW
14: LONG WINDOW
15: ATTACHED BARREL OVERLAP PORTION
16: FLANGE PORTION
18: BARREL MEMBER (BARREL PORTION)
20: BOTTOM MEMBER (BOTTOM PORTION)
21: PERIPHERAL EDGE-PORTION
21*a*: END OF PERIPHERAL EDGE PORTION
22: ANNULAR LEG
23: LOWER END OF BARREL MEMBER
24: UPPER FOLD-BACK PORTION
25: LOWER FOLD-BACK PORTION
31: CUTOUT PORTION
32: CUTOUT PORTION
201: PAPER BASE
202*a*: BARRIER LAYER
203: LAMINATED SHEET
240: THERMOPLASTIC RESIN LAYER
241: THERMOPLASTIC RESIN LAYER
242: RESIN PORTION END GAP
204: RESIN PORTION
204*a*: OUTWARDLY EXTENDING RESIN PORTION
204*b*: FOLD-BACK RESIN PORTION
204*c*: OUTWARDLY EXTENDING RESIN PORTIONS
204*d*: FOLD-BACK RESIN PORTION
210: BARREL MEMBER BLANK
211: LATERAL END EDGE HAVING RESIN PORTION
212: LATERAL END EDGE HAVING RESIN PORTION
213: LONG WINDOW
214: LONG WINDOW
215: ATTACHED PORTION
216: FLANGE PORTION
218: BARREL MEMBER
220: BOTTOM MEMBER
221: PERIPHERAL EDGE PORTION
222: ANNULAR LEG
231: CUTOUT PORTION
232: CUTOUT PORTION
D201: FIRST MEMBER.
D211: PRESSER PROJECTION
D212: GAP
D202: SECOND MEMBER
D221: PRESSER PROJECTION
D203: THIRD MEMBER
D231: PRESSER PROJECTION
401: PAPER LAYER
403: LAMINATED SHEET
404: EXTENDING RESIN LAYER
404*a*: EXTENDING RESIN LAYER

404*b*: FOLD-BACK RESIN LAYER
404*c*: EXTENDING RESIN LAYER
404*d*: FOLD-BACK RESIN LAYER
410: BARREL MEMBER BLANK
411: LATERAL END EDGE
412: LATERAL END EDGE
413: LONG WINDOW
415: ATTACHED PORTION
416: FLANGE PORTION
418: BARREL MEMBER
420: BOTTOM MEMBER
421: PERIPHERAL EDGE PORTION
422: ANNULAR LEG
431: CUTOUT PORTION OF PAPER LAYER
440: INNER-SURFACE-SIDE THERMOPLASTIC RESIN LAYER
441: OUTER-SURFACE-SIDE THERMOPLASTIC RESIN LAYER

The invention claimed is:

1. A retort cup comprising:

a tubular barrel portion formed of a barrel portion forming blank having a paper layer and thermoplastic resin layers provided on both surfaces of the paper layer; and a bottom portion which seals one of openings of the barrel portion, wherein the bottom portion has a downwardly bent peripheral edge portion, the barrel portion has an attached barrel overlap portion where both end edges of the barrel portion forming blank are overlapped with each other and sealed, a lower fold-back portion which is formed at a lower end of the barrel portion by folding back the barrel portion forming blank inwardly, and an upper fold-back portion which is formed by folding back the ends of the fold-back barrel portion forming blank inwardly, the lower end of the barrel portion, the upper fold-back portion, and the peripheral edge portion of the bottom portion are closely sealed together, with the peripheral edge portion of the bottom portion being inserted into the lower fold-back portion, the paper layer has a cutout portion in which a corner portion of the paper layer on an upper side of the tubular barrel portion is removed, and the thermoplastic resin layers include end edge extending portions that extend over a predetermined width from both respective end edges of the barrel portion.

2. The retort cup according to claim 1, wherein the end edge extending portion located inside the barrel portion in the attached barrel overlap portion is folded back to the outside of the barrel portion and located between the end edges.

3. The retort cup according to claim 1, wherein the end edge extending portion located outside the barrel portion in the attached barrel overlap portion is folded back to the inside of the barrel portion and located between the end edges.

4. The retort cup according to claim 1, wherein the end edge extending portion is provided over the total length of the end edge.

5. The retort cup according to claim 1, wherein the end edge extending portion located outside the attached barrel overlap portion comes into close contact with the barrel portion forming blank located inside the overlap portion.

6. The retort cup according to claim 1, wherein the thermoplastic resin layer includes a layer having a gas barrier property.

7. The retort cup according to claim 1, wherein the barrel portion forms a flange portion with a flat top surface.

8. The retort cup according to claim 1, wherein the corner of the paper layer of the barrel portion forming blank which is sealed by the bottom portion is cut out.

9. The retort cup according to claim 1, wherein the barrel portion has a thermoplastic resin layer provided so as to extend from the cutout portion.

10. The retort cup according to claim 1, wherein the end of the peripheral edge portion is spaced apart from each of the upper fold-back portion and the lower fold-back portion.

11. The retort cup according to claim 1, wherein at least one of the end edge extending portions is folded back and located between the end edges, and the end surface of the paper layer is protected by the fold-back resin portion of the end edge extending portion.

12. A method of manufacturing a retort cup, comprising:

punching a laminated sheet based on paper to form a blank in a predetermined shape;

forming resin portions extending outwardly from end edges of the blank, respectively;

folding back at least one of the resin portions; and barrel portion forming by closely overlapping the end edges to form an attached barrel overlap portion.

13. The method of manufacturing a retort cup according to claim 12, wherein in the folding back the resin portion, one of the resin portions is folded back, and in the barrel portion forming the end edges are closely overlapped with each other to form an attached barrel overlap portion such that the fold-back resin portion becomes the inside of the other resin portion.

14. The method of manufacturing a retort cup according to claim 12, wherein the resin portion is formed so as to seal an end surface of the blank by thermal pressure-bonding, wherein in the folding back of at least one of the resin portions, one of the resin portions is folded back so as to protect the end surface of the blank by the fold-back resin portion, and wherein in the barrel portion forming, the end edges are closely overlapped with each other to form an attached barrel overlap portion such that the fold-back resin portion becomes the inside of the other resin portion.

* * * * *